US011393425B2

(12) United States Patent
Wang et al.

(10) Patent No.: US 11,393,425 B2
(45) Date of Patent: Jul. 19, 2022

(54) PIXEL CIRCUIT, DISPLAY MODULE AND DRIVING METHOD THEREOF

(71) Applicants: ORDOS YUANSHENG OPTOELECTRONICS CO., LTD., Inner Mongolia (CN); BOE Technology Group Co., Ltd., Beijing (CN)

(72) Inventors: Jiguo Wang, Beijing (CN); Jun Fan, Beijing (CN); Xiaoyan Yang, Beijing (CN); Yusheng Liu, Beijing (CN)

(73) Assignees: ORDOS YUANSHENG OPTOELECTRONICS CO., LTD., Inner Mongolia (CN); BOE TECHNOLOGY GROUP CO., LTD., Beijing (CN)

( * ) Notice: Subject to any disclaimer, the term of this patent is extended or adjusted under 35 U.S.C. 154(b) by 66 days.

(21) Appl. No.: 16/638,207

(22) PCT Filed: Sep. 20, 2019

(86) PCT No.: PCT/CN2019/106951

§ 371 (c)(1),
(2) Date: Feb. 11, 2020

(87) PCT Pub. No.: WO2020/147337

PCT Pub. Date: Jul. 23, 2020

(65) Prior Publication Data

US 2021/0256929 A1 Aug. 19, 2021

(30) Foreign Application Priority Data

Jan. 16, 2019 (CN) ..... 201910039130.9

(51) Int. Cl.
*G09G 3/36* (2006.01)

(52) U.S. Cl.
CPC ..... *G09G 3/3696* (2013.01); *G09G 3/3648* (2013.01); *G09G 2300/0443* (2013.01);
(Continued)

(58) Field of Classification Search
CPC ..... G09G 3/3696; G09G 3/3648; G09G 2300/0443; G09G 2310/0264;
(Continued)

(56) References Cited

U.S. PATENT DOCUMENTS 10,147,344 B2 12/2018 Kuo et al.
2009/0027325 A1* 1/2009 Kim ..... G09G 3/3688 345/92

(Continued)

FOREIGN PATENT DOCUMENTS

CN 102246222 A 11/2011
CN 107578751 A 1/2018

(Continued)

OTHER PUBLICATIONS

International Search report dated Dec. 20, 2019, issued in counterpart Application No. PCT/CN2019/106951.(11 Pages).

(Continued)

*Primary Examiner* — Dennis P Joseph
(74) *Attorney, Agent, or Firm* — WHDA, LLP

(57) ABSTRACT

A pixel circuit, which may include a first pixel unit having a first display driving circuit (12), a first pixel electrode (P1), and a first control circuit (11), and a second pixel unit having a second display driving circuit (22), a second pixel electrode (P2), and a second control circuit (21). The first control circuit (11) may be configured to adjust and latch a voltage of a first positive phase node (Q1) and the first display driving circuit (12). The first display driving circuit (12) may be configured to provide a first display driving voltage to the first pixel electrode (P1). The second control circuit (21) may be configured to adjust and latch a voltage of a second positive phase node (Q2) and the second display driving circuit (22). The second display driving circuit (22) may be configured to provide a second display driving voltage to the second pixel electrode (P2).

18 Claims, 14 Drawing Sheets

(52) U.S. Cl.
CPC ..... *G09G 2300/0842* (2013.01); *G09G 2310/027* (2013.01); *G09G 2310/063* (2013.01)

(58) Field of Classification Search
CPC ..... G09G 2300/0439; G09G 3/364; G09G 3/3659; G09G 3/3607; G09G 3/36; G09G 3/3611
See application file for complete search history.

(56) References Cited

U.S. PATENT DOCUMENTS

| | | | | |
|---|---|---|---|---|
| 2013/0265347 | A1* | 10/2013 | Bae | G09G 3/3655 345/691 |
| 2019/0088214 | A1 | 3/2019 | Chen et al. | |
| 2019/0180706 | A1 | 6/2019 | Fu et al. | |
| 2019/0295464 | A1* | 9/2019 | Ishii | H01L 27/3276 |

FOREIGN PATENT DOCUMENTS

| | | | |
|---|---|---|---|
| CN | 107799089 | A | 3/2018 |
| CN | 107945763 | A | 4/2018 |
| CN | 108132570 | A | 6/2018 |
| CN | 109473079 | A | 3/2019 |
| CN | 109545137 | A | 3/2019 |
| KR | 10-2013-0100498 | A | 9/2013 |

OTHER PUBLICATIONS

Office Action dated Nov. 22, 2019, issued in counterpart CN Application No. 201910039130.9, with English translation. (93 pages).
Office Action dated Apr. 28, 2020, issued in counterpart CN Application No. 201910039130.9, with English translation. (77 pages).
Office Action dated Jul. 24, 2020, issued in counterpart CN Application No. 201910039130.9, with English translation. (38 pages).

* cited by examiner

PIXEL CIRCUIT, DISPLAY MODULE AND DRIVING METHOD THEREOF

CROSS-REFERENCE TO RELATED APPLICATIONS

This application claims benefit of the filing date of Chinese Patent Application No. 201910039130.9 filed on Jan. 16, 2019, the disclosure of which is hereby incorporated in its entirety by reference.

TECHNICAL FIELD

The present disclosure relates to display technologies, and in particular, to a pixel circuit, a display module, and a driving method of the display module.

BACKGROUND

An MIP (Memory in Pixel) pixel structure includes a first pixel unit and a second pixel unit. The first pixel unit is connected to the first display control line, and the second pixel unit is connected to the second display control line. Currently, the MIP pixel structure uses a large number of display control lines, which is not conducive to increasing the number of pixels per inch (PPI), reducing charging difference, and simplifying the structure of Gate on Array (GOA), a gate driving circuit on an array substrate, for providing display control signals.

BRIEF SUMMARY

One embodiment of the present disclosure is a pixel circuit. The pixel circuit may include a first pixel unit and a second pixel unit. The first pixel unit may include a first display driving circuit, a first pixel electrode coupled to the first display driving circuit, and a first control circuit coupled to the first display driving circuit. The second pixel unit may include a second display driving circuit, a second pixel electrode coupled to the second display driving circuit, and a second control circuit coupled to the second display driving circuit. The first display driving circuit and the second display driving circuit may be coupled to a single display control line. The first control circuit may be configured to adjust and latch a voltage of a first positive phase node coupled to the first control circuit and the first display driving circuit, and the first display driving circuit may be configured to provide a first display driving voltage to the first pixel electrode under control of a display control signal input by the display control line and the voltage of the first positive phase node; and the second control circuit may be configured to adjust and latch a voltage of a second positive phase node coupled to the second control circuit and the second display driving circuit, and the second display driving circuit may be configured to provide a second display driving voltage to the second pixel electrode under control of the display control signal and the voltage of the second positive phase node.

Optionally, the first control circuit and the second control circuit may be mirrored on both sides of the display control line, and the first display driving circuit and the second display driving circuit may be mirrored on both sides of the display control line.

Optionally, the first pixel electrode may comprise a first subpixel electrode and a second subpixel electrode coupled to each other, the first subpixel electrode, the second pixel electrode, and the second subpixel electrode may be arranged in this order.

Optionally, the first display driving circuit may comprise a first data control subcircuit and a first display control subcircuit. The first data control subcircuit is respectively coupled to the first positive phase node, a first inverting phase node coupled to the first display driving subcircuit and a first latch subcircuit, a data line, a black screen signal terminal, and a first display control node further coupled to the first display control subcircuit, and configured to control a connection between the first display control node and the black screen signal terminal under control of the first positive phase node and to control a connection between the first display control node and the data line under control of the first inverting phase node. The first display control subcircuit is respectively coupled to the display control line, the first display control node and the first pixel electrode, and configured to control a voltage of the first pixel electrode according to a voltage of the first display control node under the control the display control signal input by the display control line.

Optionally, the first display control subcircuit may comprise a first display control transistor and a first storage capacitor, a control terminal of the first display control transistor is coupled to the display control line, a first terminal of the first display control transistor is coupled to the first display control node, a second terminal of the first display control transistor is coupled to a first terminal of the first storage capacitor, and a second terminal of the first storage capacitor is coupled to the first pixel electrode.

Optionally, the first control circuit may comprise a first write control subcircuit and the first latch subcircuit coupled to the first write control subcircuit, the first write control subcircuit is configured to control a connection between the data line and the first positive phase node under control of a first write control line, and the first latch subcircuit is configured to latch the voltage of the first positive phase node, and control a voltage of the first inverting phase node according to the voltage of the first positive phase node.

Optionally, the first write control subcircuit may comprise a first write control transistor, a control terminal of the first write control transistor is coupled to the first write control line, a first terminal of the first write control transistor is coupled to the first positive phase node, and a second terminal of the first write control transistor is coupled to the data line.

Optionally, the first latch subcircuit may comprise a first inverting phase control circuit, a first inverting phase circuit, and a second inverting phase circuit. The first inverting phase control circuit is respectively coupled to the first write control line, the first positive phase node, and a first control node further coupled to the second inverting phase circuit, and configured to control a connection between the first positive phase node and the first control node under the control of the first write control line. The first inverting circuit is respectively coupled to the first positive phase node and the first inverting phase node, and configured to control the voltage of the first inverting node to be opposite phase to the voltage of the first positive phase node. The second inverting phase circuit is respectively coupled to the first control node and the first inverting phase node, and configured to control a voltage of the first control node to be opposite phase to the voltage of the first inverting phase node.

Optionally, the second display driving circuit may comprise a second data control subcircuit and a second display control subcircuit. The second data control subcircuit is respectively coupled to the second positive phase node, a second inverting phase node coupled to the second display driving subcircuit and a second latch subcircuit, a data line, a black screen signal terminal and a second display control node further coupled to the second display control subcircuit, and configured to control a connection between the second display control node and the black screen signal terminal under the control of the second positive phase node and to control a connection between the second display control node and the data line under the control of the second inverting phase node. The second display control subcircuit is respectively coupled to the display control line, the second display control node and the second pixel electrode, and configured to control a voltage of the second pixel electrode according to a voltage of the second display control node under the control the display control signal input by the display control line.

Optionally, the second display control subcircuit may comprise a second display control transistor and a second storage capacitor, a control terminal of the second display control transistor is coupled to the display control line, a first terminal of the second display control transistor is coupled to the second display control node, a second terminal of the second display control transistor is coupled to a first terminal of the second storage capacitor, and a second terminal of the second storage capacitor is coupled to the second pixel electrode.

Optionally, the second control circuit may comprise a second write control subcircuit and the second latch subcircuit coupled to the second write control subcircuit, the second write control subcircuit is configured to control a connection between the data line and the second positive phase node under control of a second write control line, the second latch subcircuit is configured to latch the voltage of the second positive phase node and control a voltage of the second inverting phase node according to the voltage of the second positive phase node.

Optionally, the second write control subcircuit may comprise a second write control transistor, a control terminal of the second write control transistor is coupled to the second write control line, a first terminal of the second write control transistor is coupled to the second positive phase node, and a second terminal of the second write control transistor is coupled to the data line.

Optionally, the second latch subcircuit comprises a second inverting phase control circuit, a third inverting phase circuit, and a fourth inverting phase circuit. The second inverting phase control circuit is respectively coupled to the second write control line, the second positive phase node, and a second control node, and configured to control a connection between the second positive phase node and the second control node under the control of the second write control line. The third inverting phase circuit is respectively coupled to the second positive phase node and the second inverting phase node, and configured to control the voltage of the second inverting phase node to be opposite phase to the voltage of the second positive phase node. The fourth inverting phase circuit is respectively coupled to the second control node and the second inverting phase node, and configured to control a voltage of the second control node to be opposite phase to the voltage of the second inverting phase node.

One embodiment of the present disclosure is a pixel circuit driving method for driving the pixel circuit, wherein a display period comprises a data writing phase and a display time phase which are set in this order, the data writing phase comprises a first data writing phase and a second data writing phase. The pixel circuit driving method may comprise: during the first data writing time phase, controlling and adjusting the voltage of the first positive phase node by the first control circuit; during the second data writing time phase, controlling and adjusting the voltage of the second positive phase node by the second control circuit; during the display time phase, latching the voltage of the first positive phase node by the first control circuit, latching the voltage of the second positive phase node by the second control circuit, providing the first display driving voltage to the first pixel electrode by the first display driving circuit under the control of the display control signal input from the display control line and the voltage of the first positive phase node, and providing the second display driving voltage to the second pixel electrode by the second display driving circuit under the control of the display control signal and the voltage of the second positive phase node.

One embodiment of the present disclosure is a display module, comprising N rows and a plurality of columns of pixel circuits comprising the pixel circuit, and N rows of display control lines, wherein N is an integer greater than one. The first pixel units in a nth row of the pixel circuits and second pixel units in the nth row of the pixel circuits are coupled to the nth row of the display control line, and n is a positive integer less than or equal to N.

Optionally, the first display driving circuits in the first pixel units and second display driving circuits in the second pixel units may be coupled to the nth row of the display control line.

Optionally, the display module may further comprise 2N rows of write control lines, wherein the first pixel units in the nth row of the pixel circuits are coupled to the (2n−1)th row of write control line, and the second pixel units in the nth row of the pixel circuits are coupled to the 2nth row of write control line.

Optionally, the first control circuits in the first pixel units may be coupled to the (2n−1)th row of the write control line, and second control circuits in the second pixel units may be coupled to the 2nth row of the write control line.

One embodiment of the present disclosure is a display module driving method for driving the display module, wherein in a black and white screen display mode, a display period includes a data writing phase and a display phase which are set in this order. The data writing phase comprises 2N data writing time phases that are sequentially set, n is a positive integer less than or equal to N, the display module driving method comprises: during the (2n−1)th data writing time phase, controlling and adjusting the voltage of the first positive phase node in the first pixel unit by the first control circuit of the first pixel unit in one of the nth row of the pixel circuits; during the 2nth data writing time phase, controlling and adjusting the voltage of the second positive phase node in the second pixel unit by the second control circuit of the second pixel unit in one of the nth row of the pixel circuits; and during the display phase, latching the voltage of the first positive phase node by the first control circuit, latching the voltage of the second positive phase node by the second control circuit, turning on all rows of the display control lines in the display module, providing first display driving voltages to first pixel electrodes by first display driving circuits of all the pixel circuits in the display module under control of display control signals input by the corresponding display control lines and voltages of first positive phase nodes, and providing second display driving voltages to second pixel electrodes by second display driving circuits of all the pixel circuits in the display module under the control of display control signals input by the corresponding display control lines and voltages of second positive phase nodes.

One embodiment of the present disclosure is a display module driving method for driving a display module, wherein in a grayscale display mode, a display period includes a data writing phase and a display phase which are set in this order, the data writing phase comprises 2N data writing time phases that are sequentially set, the display phase includes N display time phases that are sequentially set, n is a positive integer less than or equal to N. The display module driving method comprises: during the (2n−1)th data writing time phase, controlling and adjusting the voltage of the first positive phase node in the first pixel unit by the first control circuit of the first pixel unit in one of the nth row of the pixel circuits; during the 2nth data writing time phase, controlling and adjusting the voltage of the second positive phase node in the second pixel unit by the second control circuit of the second pixel unit in one of the nth row of the pixel circuits; during the display phase, latching the voltage of the first positive phase node by the first control circuit, and latching the voltage of the second positive phase node by the second control circuit; during the nth display time phase, turning on the nth row of the display control line in the display module to control the first display control circuits of the first pixel units in the nth row of the pixel circuits to provide the first display driving voltage to the first pixel electrode under the control of the display control signal input by the nth row of the display control line and the voltage of the first positive phase node, and to control the second display control circuits of the second pixel units in the nth row of the pixel circuits to provide the second display driving voltage to the second pixel electrode under the control of the display control signal input by the nth row of the display control line and the voltage of the second positive phase node.

BRIEF DESCRIPTION OF THE DRAWINGS

The drawings are intended to provide a further understanding of the technical solutions of the present disclosure, and are intended to be a part of the specification, and are used to explain the technical solutions of the present disclosure, and do not constitute a limitation of the technical solutions of the present disclosure.

DETAILED DESCRIPTION

Figure 1:
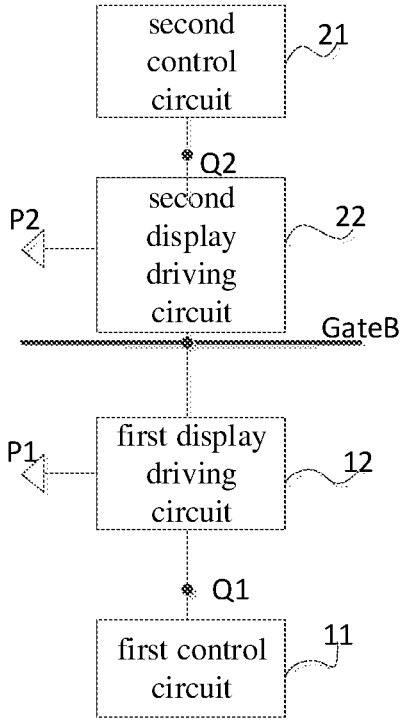
FIG. 1 is a schematic diagram of a pixel circuit according to one embodiment of the present disclosure.

The present disclosure will be further described in detail with reference to the accompanying drawings. When referring to the figures, like structures and elements shown throughout are indicated with like reference numerals. Obviously, the described embodiments are only a part of the embodiments of the present disclosure, not all of the embodiments. All other embodiments obtained by a person of ordinary skill in the art based on the embodiments of the present disclosure without creative efforts are within the protection scope of the present disclosure. In the description of the following embodiments, specific features, structures, materials or characteristics may be combined in any suitable manner in any one or more embodiments or examples.

The transistors used in all embodiments of the present disclosure may each be a bipolar junction transistor, a thin film transistor or a field effect transistor or other device having the same or similar characteristics. In order to distinguish the two terminals of the transistor except the control terminal, one of the terminals is referred to as a first terminal, and the other terminal is referred to as a second terminal.

In operation, when the transistor is a bipolar junction transistor, the control terminal may be a base, the first terminal may be a collector, and the second terminal may be an emitter; or the control terminal may be a base, the first terminal may be an emitter and the second terminal may be a collector.

In operation, when the transistor is a thin film transistor or a field effect transistor, the control terminal may be a gate, the first terminal may be a drain, and the second terminal may be a source; or, the control terminal may be a gate, the first terminal may be a source, and the second terminal may be a drain.

In one embodiment of the present disclosure, the pixel circuit includes a first pixel unit and a second pixel unit as shown in FIG. 1. The first pixel unit includes a first pixel electrode P1, a first control circuit 11, and a first display driving circuit 12. The second pixel unit includes a second pixel electrode P2, a second control circuit 21, and a second display driving circuit 22.

The first display driving circuit 12 and the second display driving circuit 22 are connected to the same display control line GateB.

The first control circuit 11 is used to control and adjust a voltage of the first positive phase node Q1 and latch the voltage of the first positive phase node Q1.

The first display driving circuit 12 is configured to provide a first display driving voltage to the first pixel electrode P1 under the control of the display control signal input by the display control line GataB and the voltage of the first positive phase node Q1.

The second control circuit 21 is used to control and adjust the voltage of the second positive phase node Q2 and latch the voltage of the second positive phase node Q2.

The second display driving circuit 22 is configured to provide a second display driving voltage to the second pixel electrode P2 under the control of the display control signal and the voltage of the second positive phase node Q2.

In one embodiment, the pixel circuit includes two pixel units, and the two pixel units share a display control line GateB. The first control circuit in the first pixel unit latches the voltage of the first positive phase node, and the second control circuit in the second pixel unit latches the voltage of the second positive phase node. The first pixel unit and the second pixel unit are MIP (Memory In Pixel, a latch in the pixel) pixel units. The pixel circuit can reduce the use of a display control line and save layout space of the display control line. Accordingly, the pixel pitch in the display panel can be made smaller, thereby increasing the PPI. Furthermore, the first pixel unit and the second pixel unit controlled by the same display control line GateB may experience less charging difference. Furthermore, one less display control line reduces the number of the display control signals output by the corresponding GOA. Accordingly, the output levels of the GOA are reduced by one level, thereby saving border space of the display panel for a narrower border.

In one embodiment, when the pixel circuit shown in FIG. 1 is in operation, the display period includes a data writing phase and a display time phase which are sequentially set, and the data writing phase includes the first data writing time phase and the second data writing time phase.

During the first data writing time phase, the first control circuit 11 controls and adjusts the voltage of the first positive phase node Q1.

During the second data writing time phase, the second control circuit 21 controls and adjusts the voltage of the second positive phase node Q2.

During the data writing phase and the display time phase, the first control circuit 11 latches the voltage of the first positive phase node Q1, and the second control circuit 21 latches the voltage of the second positive phase node Q2.

During the display time phase, the first display driving circuit 12 provides a first display driving voltage to the first pixel electrode P1 under the control of the display control signal input from the display control line and the voltage of the first positive phase node Q1. The second display driving circuit 22 provides a second display driving voltage to the second pixel electrode P2 under the control of the display control signal and the voltage of the second positive phase node Q2.

When the pixel circuit in one embodiment is in operation, the first control circuit adjusts and latches the voltage of the first positive phase node, and the second control circuit adjusts and latches the voltage of the second positive phase node. The first display driving circuit and the second display driving circuit performs display control under the control of the same display control signal.

Optionally, the first control circuit and the second control circuit may be mirrored on both sides of the display control line, and the first display driving circuit and the second display driving circuit may be mirrored on both sides of the display control line.

Optionally, the first control circuit and the second control circuit may be mirrored. The first display driving circuit and the second display driving circuit are mirrored so as to conveniently share the same display control line. The following will be described in conjunction with a circuit structure.

In one embodiment, the first pixel electrode may include a first subpixel electrode and a second subpixel electrode electrically connected to each other;

The first subpixel electrode, the second pixel electrode, and the second subpixel electrode are arranged in this order.

Figure 2A:
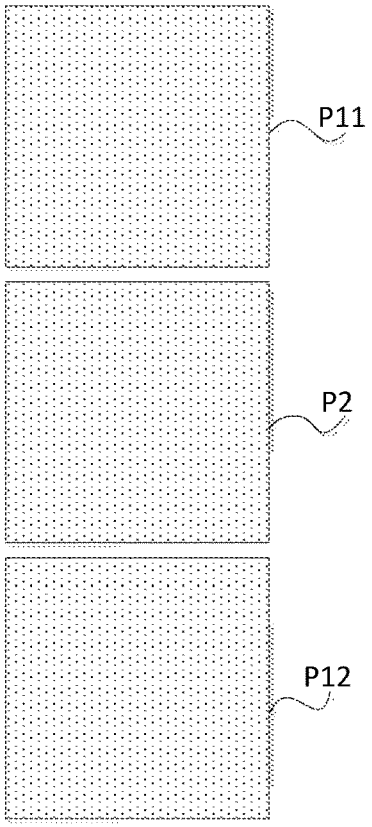
FIG. 2A is a schematic diagram showing an arrangement of a first pixel electrode and a second pixel electrode in a pixel circuit according to one embodiment of the disclosure.

In one embodiment, as shown in FIG. 2A, the pixel circuit includes a first pixel electrode and a second pixel electrode P2. The first pixel electrode includes a first subpixel electrode P11 and a second subpixel electrode P12. The subpixel electrode P11 and the second subpixel electrode P12 are electrically connected to each other.

The first subpixel electrode P11, the second pixel electrode P2 and the second subpixel electrode P12 are disposed sequentially from top to bottom.

The corresponding display area of the first subpixel electrode P11 and the corresponding display area of the second subpixel electrode P12 forms a Large Pixel Bit (LPB). The corresponding display area of the second pixel electrode P2 forms a Small Pixel Bit (SPB). LPB may account for ⅔ of the entire display area, and SPB may account for ⅓ of the entire display area.

Figure 2B:
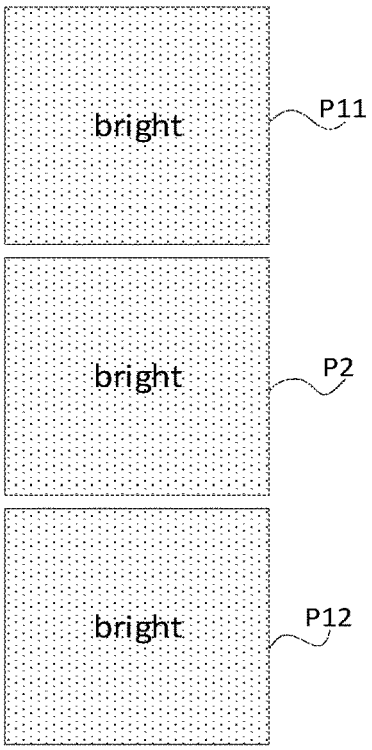
FIG. 2B is a schematic diagram of a first grayscale implemented by the pixel circuit shown in FIG. 2A.
Figure 2C:
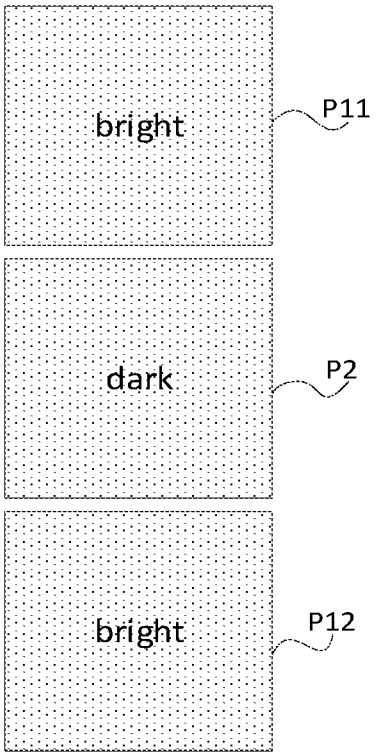
FIG. 2C is a schematic diagram of a second grayscale implemented by the pixel circuit shown in FIG. 2A.
Figure 2D:
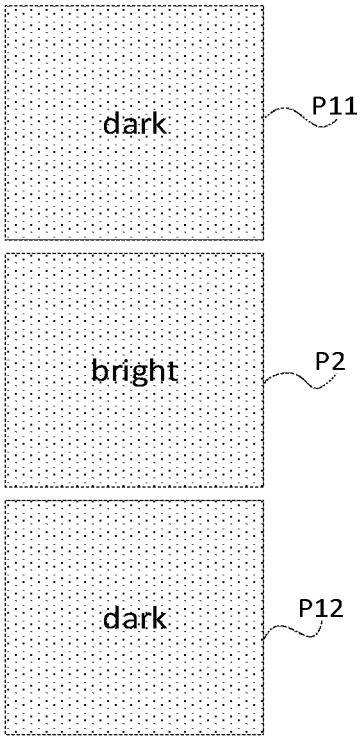
FIG. 2D is a schematic diagram of a third grayscale implemented by the pixel circuit shown in FIG. 2A.
Figure 2E:
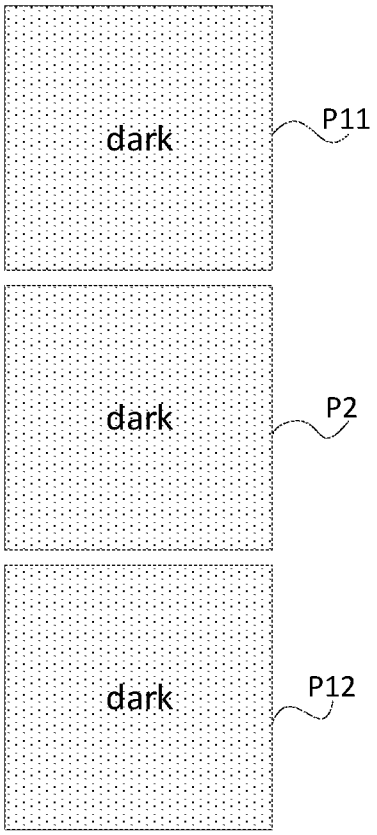
FIG. 2E is a schematic diagram of a fourth grayscale implemented by the pixel circuit shown in FIG. 2A.

The first control circuit and the first display control circuit in the first pixel unit control the voltage of the first sub-pixel electrode P11 and the voltage of the second subpixel electrode P12 to perform display control on the LPB. In the second pixel unit, the second control circuit and the second display control circuit control the voltage of the second pixel electrode P2 to perform display control on the SPB. Therefore, a pixel circuit can achieve four gray levels: LPB is bright and SPB is bright in FIG. 2B, LPB is bright and SPB is dark in FIG. 2C, LPB is dark and SPB is bright in FIG. 2D, and LPB is dark and SPB is dark in FIG. 2E. The pixel circuit may be a red subpixel circuit, a green subpixel circuit or a blue subpixel circuit. If a pixel includes a red subpixel circuit, a green sub-pixel circuit, and a blue subpixel circuit, the pixel can achieve 64 gray levels and 64 colors.

Figure 3:
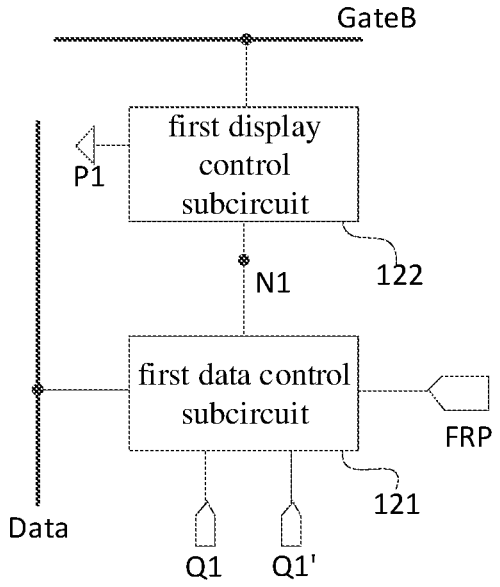
FIG. 3 is a schematic diagram of a first display driving circuit in a pixel circuit according to one embodiment of the present disclosure.

In one embodiment, as shown in FIG. 3, the first display driving circuit may include a first data control subcircuit 121 and a first display control subcircuit 122.

The first data control subcircuit 121 is connected to the first positive phase node Q1, a first inverting phase node Q1', a data line Data, a black screen signal terminal FRP and the first display control node N1, respectively. Under the control of the first positive phase node Q1, the first data control subcircuit turns on or off the connection between the first display control node N1 and the black screen signal terminal FRP. Under the control of the first inverting phase node Q1', the first data control subcircuit turns on or off the connection between the first display control node N1 and the data line Data.

The first display control subcircuit 122 is connected to the display control line GateB, the first display control node N1 and the first pixel electrode P1, respectively. Under the control of the display control line GateB, the first display control subcircuit controls the voltage of the first pixel electrode P1 according to the voltage of the first display control node N1.

When the first display driving circuit shown in FIG. 3 is in operation, during the display time phase, the first data control subcircuit 121 controls the voltage of N1 by controlling the connection of N1 to the black screen signal terminal FRP or the data line Data, and the first display control subcircuit 122 controls the voltage of P1 according to the voltage of N1 under the control of the display control line GateB, thereby performing display control.

Optionally, the first display control subcircuit may include a first display control transistor and a first storage capacitor.

In one embodiment, the control terminal of the first display control transistor is connected to the display control line. The first terminal of the first display control transistor is connected to the first display control node, and the second terminal of the first display control transistor is connected to the first terminal of the first storage capacitor.

The second terminal of the first storage capacitor is connected to the first pixel electrode.

Optionally, the first data control subcircuit may include a first data control transistor and a second data control transistor.

In one embodiment, the control terminal of the first data control transistor is connected to the first positive phase node, the first terminal of the first data control transistor is connected to the black screen signal terminal, and the second terminal of the first data control transistor is connected to the first display control node.

The control terminal of the second data control transistor is connected to the first inverting phase node, the first terminal of the second data control transistor is connected to the first display control node, and the second terminal of the second data control transistor is connected to the data line.

Figure 4:
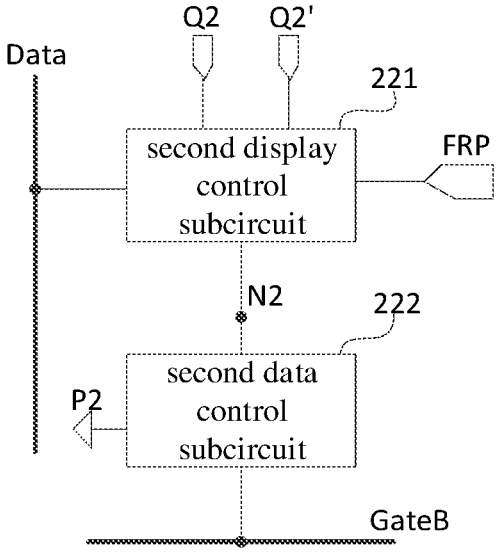
FIG. 4 is a schematic diagram of a second display driving circuit in a pixel circuit according to one embodiment of the present disclosure.

In one embodiment, as shown in FIG. 4, the second display driving circuit may include a second data control subcircuit 221 and a second display control subcircuit 222.

The second data control subcircuit 221 is connected to the second positive phase node Q2, the second inverting phase node Q2', the data line Data, the black screen signal terminal FRP and the second display control node N2, respectively. The second data control subcircuit, under the control of the second positive phase node Q2, turns on or off the connection between the second display control node N2 and the black screen signal terminal FRP, and under the control of the second inverting phase node Q2', turns on or off the connection between the second display control node N2 and the data line Data.

In one embodiment, the second display control subcircuit 222 is connected to the display control line GateB, the second display control node N2 and the second pixel electrode P2, respectively. Under the control of the display control line GateB, the second display control subcircuit controls the voltage of the second pixel electrode P2 according to the voltage of the second display control node N2.

When the second display driving circuit shown in FIG. 4 is in operation, during the display time phase, the second data control subcircuit 221 controls the voltage of N2 by controlling the connection of N2 to the black screen signal terminal FRP or the data line Data, and the second display control subcircuit 222 controls the voltage of P2 according to the voltage of N2 under the control of the display control line GateB, thereby performing display control.

Optionally, the second display control subcircuit may include a second display control transistor and a second storage capacitor.

In one embodiment, the control terminal of the second display control transistor is connected to the display control line, the first terminal of the second display control transistor is connected to the second display control node, and the second terminal of the second display control transistor is connected to the first terminal of the second storage capacitor.

The second terminal of the second storage capacitor is connected to the second pixel electrode.

Optionally, the second data control subcircuit may include a third data control transistor and a fourth data control transistor.

In one embodiment, the control terminal of the third data control transistor is connected to the second positive phase node, the first terminal of the second data control transistor is connected to the black screen signal terminal, and the second terminal of the second data control transistor is connected to the second display control node.

The control terminal of the fourth data control transistor is connected to the second inverting phase node, the first terminal of the fourth data control transistor is connected to the second display control node, and the second terminal of the fourth data control transistor is connected to the data line.

Figure 5:
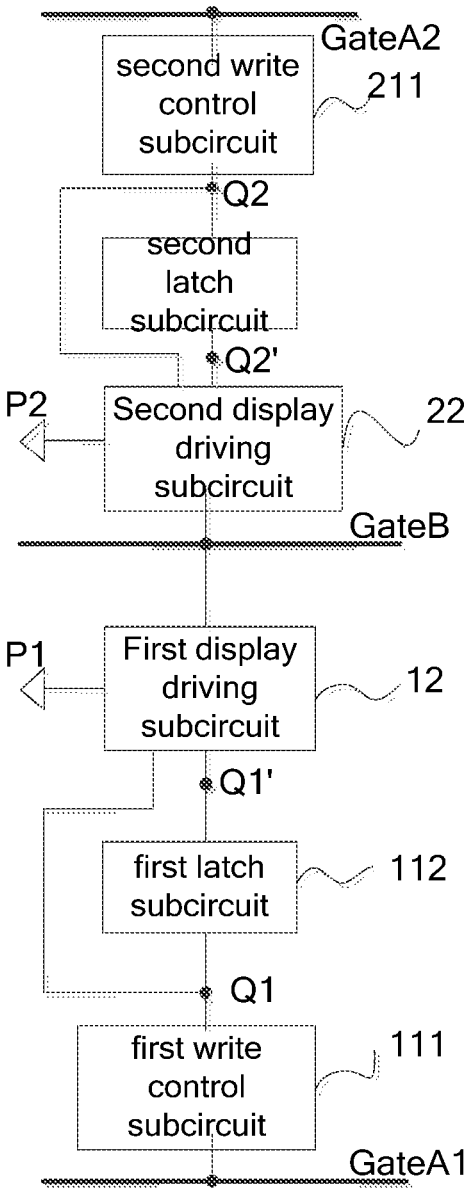
FIG. 5 is a schematic diagram of a pixel circuit according to one embodiment of the present disclosure.

In one embodiment, on the basis of one embodiment of the pixel circuit shown in FIG. 1, the first control circuit may include a first write control subcircuit 111 and a first latch subcircuit 112 as shown in FIG. 5.

The first write control subcircuit 111 is used to control the connection between the data line Data and the first positive phase node Q1 under the control of the first write control line GateA1.

The first latch subcircuit 112 is used to latch the voltage of the first normal phase node Q1, and control the voltage of the first inverting phase node Q1' according to the voltage of the first normal phase node Q1.

The first display driving circuit 12 is also connected to the first inverting phase node Q1'.

The second control circuit includes a second write control subcircuit 211 and a second latch subcircuit 212.

The second write control subcircuit 211 is used to control the connection between the data line Data and the second positive phase node Q2 under the control of the second write control line GateA2.

The second latch subcircuit 212 is used to latch the voltage of the second normal phase node Q2, and control the voltage of the second inverting phase node Q2' according to the voltage of the second positive phase node Q2.

The second display driving circuit 22 is also connected to the second inverting phase node Q2'.

In one embodiment, when the pixel circuit shown in FIG. 5 is in operation, during the first data writing time phase, GateA1 is turned on, which controls writing the voltage on the Data to Q1 so as to control and adjust the voltage of Q1. During the writing time phase, GateA2 is turned on, which controls writing the voltage on the Data to Q2 so as to control and adjust the voltage of Q2. During the data writing phase, the first latch subcircuit 112 latches the voltage of Q1 and controls the voltage of Q1' according to the voltage of Q1, and the second latch subcircuit 212 latches the voltage of Q2 and controls the voltage of Q2' according to the voltage of Q2.

Optionally, when the voltage of Q1 is a high voltage, the first latch subcircuit 112 controls the voltage of Q1' to be a low voltage. When the voltage of Q1 is a low voltage, the first latch subcircuit 112 controls the voltage of Q1' to be a high voltage. When the voltage of Q2 is a high voltage, the second latch subcircuit 212 controls the voltage of Q2' to be a low voltage. When the voltage of Q2 is a low voltage, the second latch subcircuit 212 controls the voltage of Q2 to be a high voltage.

In one embodiment, the first write control subcircuit may include a first write control transistor, and the second write control subcircuit may include a second write control transistor.

In one embodiment, the control terminal of the first write control transistor is connected to a first write control line, the first terminal of the first write control transistor is connected to the first positive phase node Q1, the second terminal of the first write control transistor is coupled to the data line.

The control terminal of the second write control transistor is connected to a second write control line, the first terminal of the second write control transistor is connected to the second positive phase node Q2, and the second terminal of the second write control transistor is connected to the data line.

Figure 6:
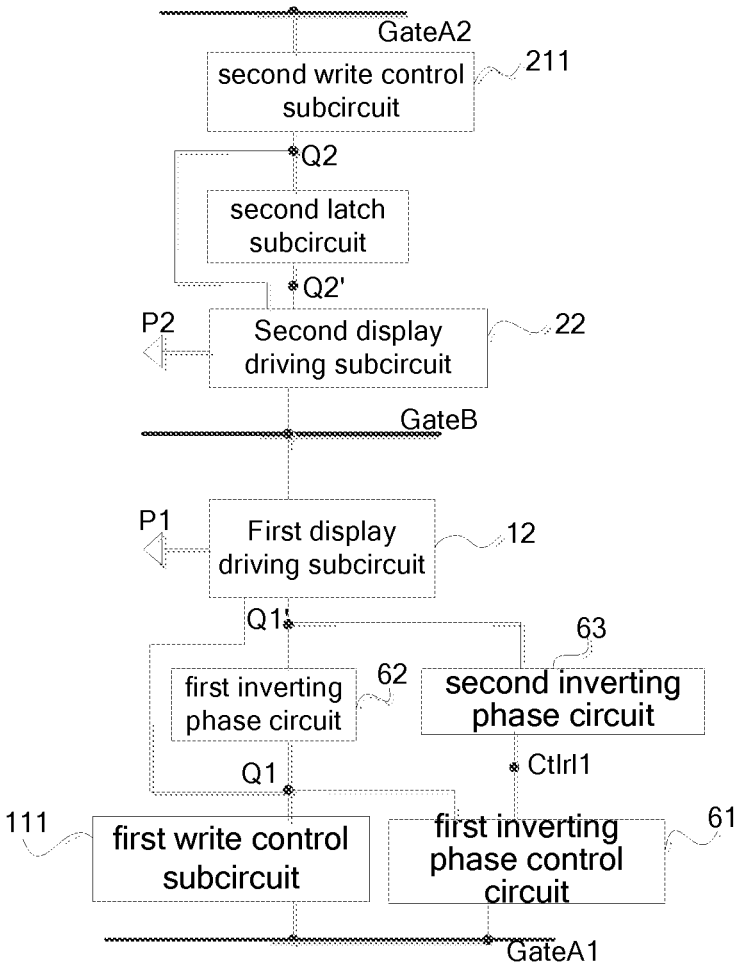
FIG. 6 is a schematic diagram of a pixel circuit according to one embodiment of the present disclosure.

On the basis of one embodiment of the pixel circuit shown in FIG. 5, the first latch subcircuit may include a first inverting phase control circuit 61, a first inverting phase circuit 62, and a second inverting phase circuit 63 as shown in FIG. 6.

The first inverting phase control circuit 61 is connected to the first write control line GateA1, the first positive phase node Q1 and the first control node Ctrl1, respectively. Under the control of the control line GateA1, the first inverting phase control circuit turns on or off connection between the first positive phase node Q1 and the first control node Ctrl1.

The first inverting phase circuit 62 is respectively connected to the first positive phase node Q1 and the first inverting phase node Q1', which is used to control the voltage of the first inverting phase node Q1' to be an opposite phase to the voltage of the first positive phase node Q1.

The second inverting phase circuit 63 is respectively connected to the first control node Ctrl1 and the first inverting phase node Q1', which is used to control the voltage of the first control node Ctrl1 to be opposite phase to the voltage of the first inverting phase node Q1'.

In one embodiment, when the pixel circuit shown in FIG. 6 is in operation, during the first data writing time phase, under the control of GateA1, the first inverting phase control circuit 61 turns off the connection between Q1 and Ctrl1 to improve reliability in race hazards. In one embodiment, the first pixel unit in the pixel circuit may be provided with a first inverting phase control circuit 61. During the first data writing time phase, under the control of the first write control line GateA1, the first inverting phase control circuit 61 turns off the connection between the first positive phase node Q1 and the first control node Ctrl1. Therefore, the first inverting phase circuit 62 and the second inverting phase circuit 63 are disconnected, so that the state of the first positive phase node Q1 is not disturbed by the limited driving capability of the transistors in the first write control subcircuit 111, which prevent uncontrollable states and the resulted race hazards.

Optionally, the first inverting control circuit may include a first inverting phase control transistor.

The control terminal of the first inverting phase control transistor is connected to the first write control line, the first terminal of the first inverting phase control transistor is connected to the first positive phase node, and the second terminal of the first inverting phase control transistor is connected to the first control node.

Optionally, the first inverting phase circuit may include a first inverting phase transistor and a second inverting phase transistor.

The control terminal of the first inverting phase transistor is connected to the first positive phase node, the first terminal of the first inverting phase transistor is connected to the first inverting phase node, and the second terminal of the first inverting phase transistor is connected to the first voltage terminal.

The control terminal of the second inverting phase transistor is connected to the first positive phase node, the first terminal of the second inverting phase transistor is connected to a second voltage terminal, and the second terminal of the second inverting phase transistor is connected to the first inverting phase node.

The second inverting phase circuit includes a third inverting phase transistor and a fourth inverting phase transistor.

The control terminal of the third inverting phase transistor is connected to the first inverting phase node, the first terminal of the third inverting phase transistor is connected to the first control node, and the second terminal of the third inverting phase transistor is connected to the first voltage terminal.

The control terminal of the fourth inverting phase transistor is connected to the first inverting phase node, the first terminal of the fourth inverting phase transistor is connected to a second voltage terminal, and the second terminal of the fourth inverting phase transistor is connected to the first control node.

In one embodiment, the first voltage terminal may be a low voltage terminal, and the second voltage terminal may be a high voltage terminal, but not limited thereto.

Figure 7:
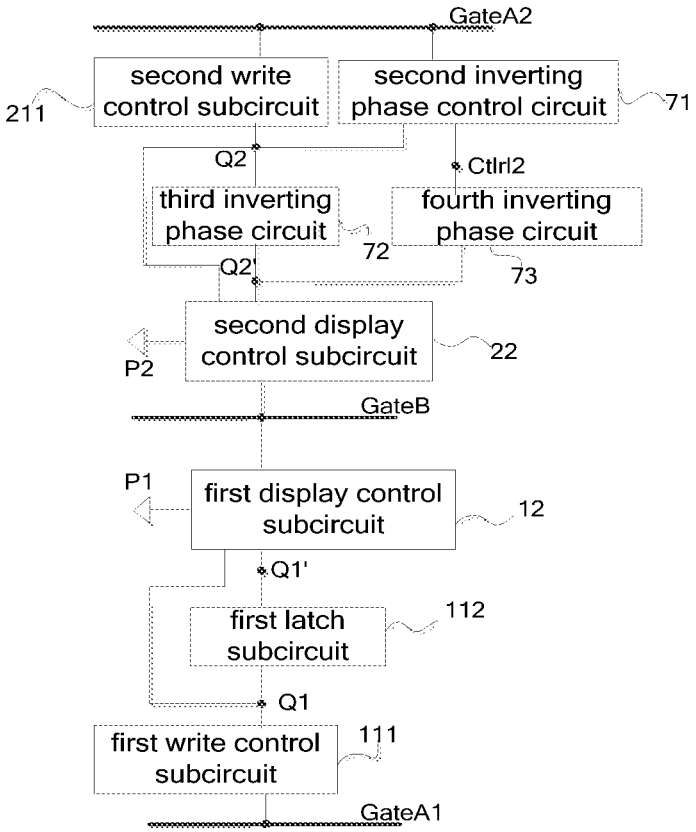
FIG. 7 is a schematic diagram of a pixel circuit according to one embodiment of the present disclosure.

On the basis of the pixel circuit shown in FIG. 5 in one embodiment, the second latch subcircuit may include a second inverting phase control circuit 71, a third inverting phase circuit 72, and a fourth inverting phase circuit 73 as shown in FIG. 7.

The second inverting phase control circuit 71 is connected to the second write control line GateA2, the second positive phase node Q2 and the second control node Ctrl2, respectively. Under the control of the second write control line GateA2, the second inverting phase control circuit turn on or off the connection between the second positive phase node Q2 and the second control node Ctrl2.

The third inverting phase circuit 72 is respectively connected to the second positive phase node Q2 and the second inverting phase node Q2', and is used to control the voltage of the second inverting phase node Q2' to be opposite phase to the voltage of the second positive phase node.

The fourth inverting phase circuit 73 is respectively connected to the second control node Ctrl2 and the second inverting phase node Q2', and is used to control the voltage of the second control node Ctrl2 to be opposite phase to the voltage of the second inverting phase node Q2'.

In one embodiment, when pixel circuit shown in FIG. 7 is in operation, during the second data writing time phase, under the control of GateA2, the second inverting phase control circuit 71 turn off the connection between Q2 and Ctrl2 to improve reliability in race hazards. In one embodiment, the second pixel unit in the pixel circuit may be provided with a second inverting phase control circuit 71. During the second data writing time phase, under the control of the second write control line GateA2, the second inverting phase control circuit 71 turns off the connection between the second positive phase node Q2 and the second control node Ctrl2, so that the third inverting phase circuit 72 is disconnected to the fourth inverting phase circuit 73. Therefore, the state of the second positive phase node Q2 is not disturbed by the limited driving capability of the transistors of the second write control subcircuit 211, thereby preventing uncontrollable states and the resulted race hazards.

Optionally, the second inverting phase control circuit may include a second inverting phase control transistor.

In one embodiment, the control terminal of the second inverting phase control transistor is connected to the second write control line, the first terminal of the second inverting phase control transistor is connected to the second positive phase node, and the second terminal of the second inverting phase control transistor is connected to the second control node.

Optionally, the third inverting phase circuit may include a fifth inverting transistor and a sixth inverting transistor.

In one embodiment, the control terminal of the fifth inverting phase transistor is connected to the second positive phase node, the first terminal of the fifth inverting phase transistor is connected to the second inverting phase node, and the second terminal of the fifth inverting phase transistor is connected to the first voltage terminal.

The control terminal of the sixth inverting phase transistor is connected to the second positive phase node, the first terminal of the sixth inverting phase transistor is connected to a second voltage terminal, and the second terminal of the sixth inverting phase transistor is connected to the second inverting node.

The fourth inverting phase circuit includes a seventh inverting phase transistor and an eighth inverting phase transistor.

The control terminal of the seventh inverting phase transistor is connected to the second inverting phase node, the first terminal of the seventh inverting phase transistor is connected to the second control node, and the second terminal of the seventh inverting phase transistor is connected to the first voltage terminal.

The control terminal of the eighth inverting phase transistor is connected to the second inverting phase node, the first terminal of the eighth inverting phase transistor is connected to a second voltage terminal, and the second terminal of the eighth inverting phase transistor is connected to the second control node.

In one embodiment, the first voltage terminal may be a low voltage terminal, and the second voltage terminal may be a high voltage terminal, but not limited thereto.

The operation of the first pixel unit will be described below in conjunction with the structure of the first pixel unit.

Figure 8:
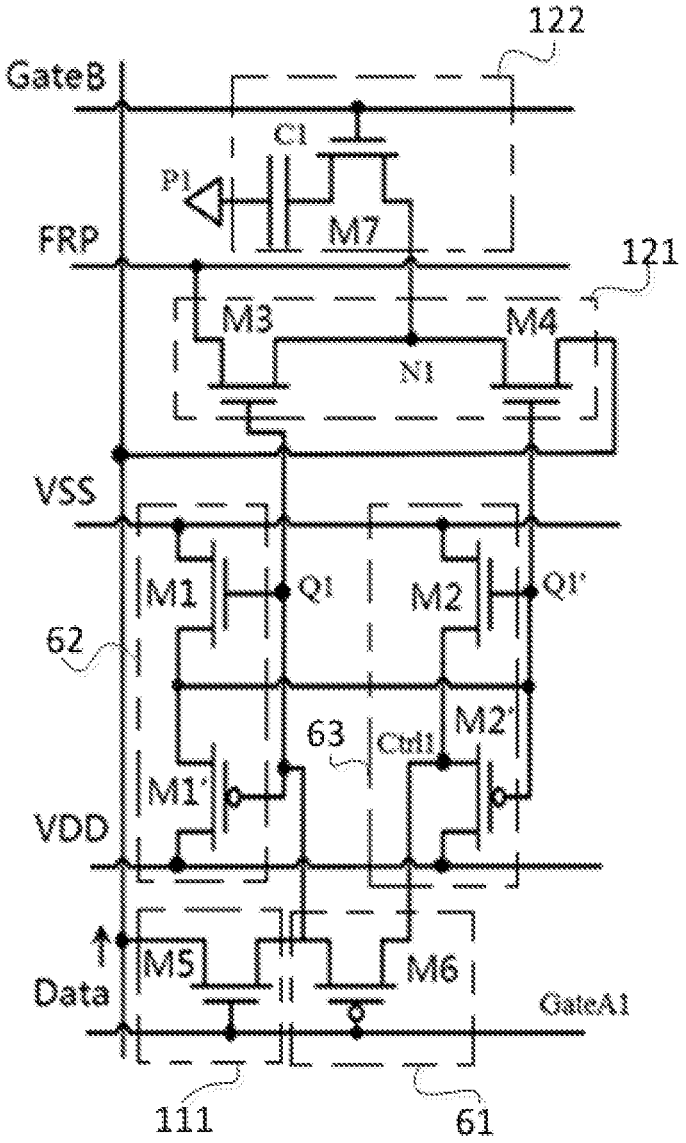
FIG. 8 is a circuit diagram of a first pixel unit in the pixel circuit according to one embodiment of the present disclosure.

In one embodiment, the first pixel unit includes a first pixel electrode P1, a first control circuit, and a first display driving circuit as shown in FIG. 8.

The first display driving circuit includes a first data control subcircuit 121 and a first display control sub-circuit 122.

The first display control subcircuit 122 includes a first display control transistor M7 and a first storage capacitor C1.

The gate of the first display control transistor M7 is connected to the display control line GateB, the drain of the first display control transistor M7 is connected to the first display control node N1, and the source of the first display control transistor M7 is connected to the first terminal of the first storage capacitor C1.

The second terminal of the first storage capacitor C1 is connected to the first pixel electrode P1.

The first data control subcircuit 121 includes a first data control transistor M3 and a second data control transistor M4.

The gate of the first data control transistor M3 is connected to the first positive phase node Q1, the drain of the first data control transistor M3 is connected to the black screen signal terminal FRP, and the source of the first data control transistor M3 is connected to the first display control node N1.

The gate of the second data control transistor M4 is connected to the first inverting phase node Q1', the drain of the second data control transistor M4 is connected to the first display control node N1, and the source of the second data control transistor M4 is connected to the data line Data.

The first control circuit includes a first write control subcircuit 111 and a first latch subcircuit.

The first latch subcircuit includes a first inverting phase control circuit 61, a first inverting phase circuit 62, and a second inverting phase circuit 63.

The first inverting phase control circuit 61 includes a first inverting phase control transistor M6.

The gate of the first inverting phase control transistor M6 is connected to the first write control line GateA1, the source of the first inverting phase control transistor M6 is connected to the first positive phase node Q1, and the drain of the first inverting phase control transistor M6 is connected to the first control node Ctrl1.

The first inverting phase circuit 62 includes a first inverting phase transistor M1 and a second inverting phase transistor Mr.

The gate of the first inverting phase transistor M1 is connected to the first positive phase node Q1, the source of the first inverting phase transistor M1 is connected to a low voltage terminal for inputting a low voltage VSS, and the drain of the first inverting phase transistor M1 is connected to the first inverting phase node Q1'.

The gate of the second inverting phase transistor M1' is connected to the first positive phase node Q1, the drain of the second inverting phase transistor M1' is connected to the first inverting phase node Q1', and the source of the second inverting phase transistor M1' is connected to a high voltage terminal for inputting a high voltage VDD.

The second inverting phase circuit 63 includes a third inverting phase transistor M2 and a fourth inverting phase transistor MT.

The gate of the third inverting phase transistor M2 is connected to the first inverting phase node Q1', the source of the third inverting phase transistor M2 is connected to the low voltage terminal, and the drain of the third inverting phase transistor M2 is connected to the first control node Ctrl1.

The gate of the fourth inverting phase transistor M2' is connected to the first inverting phase node Q1', the drain of the fourth inverting phase transistor M2' is connected to the first control node Ctrl1, and the source of the fourth inverting phase transistor MT is connected to the high voltage terminal.

The first write control subcircuit 111 includes a first write control transistor M5.

The gate of the first write control transistor M5 is connected to a first write control line GateA1, the source of the first write control transistor M5 is connected to the data line Data, and the drain of the first write control transistor M5 is connected to the first positive phase node Q1.

In one embodiment, M6, M1' and MT in the first pixel unit of FIG. 8 are a P-type metal-oxide-semiconductor field effect transistor (PMOS transistor), and other transistors are an N-type metal-oxide-semiconductor field effect transistor (NMOS transistor), but not limited thereto.

In one embodiment, when the first pixel unit shown in FIG. 8 is displaying at 1 Hz (hertz), that is, when displaying a black and white screen, the FRP inputs a constant black signal.

During displaying of a black screen:

during the first data write time phase, GateB outputs a low level, GateA1 outputs a high level, M5 is turned on, M6 is turned off, and Data writes a high level, then the potential of Q1 is set to a high level, and M1 is turned on to set the potential of Q1' to a low level, MT is turned on so that Ctrl1 is set to a high voltage. M3 is turned on, M4 is turned off, and the constant black signal input from FRP is written to N1; and during the display time phase, GateA1 outputs a low level, GateB outputs a high level, M5 is turned off, M6 is turned on to turn on the connection between Q1 and Ctrl1, and the voltage of Q1 is maintained at a high level. M7 is turned on to write the constant black signal to the first pixel electrode P1 for displaying a black screen.

During displaying of a white screen:

during the first data write time phase, GateB outputs a low level, GateA1 outputs a high level, M5 is turned on, M6 is turned off, and Data is written to a low level, then the potential of Q1 is set to a low level, and M1' is turned on to set Q1' to a high level. M2 is turned on, so that Ctrl1 is set to a low voltage. M3 is turned off, and M4 is turned on;

during the display time phase, GateA1 outputs a low level, GateB outputs a high level, M5 is turned off, M6 is turned on to turn on the connection between Q1 and Ctrl1, the voltage of Q1 is maintained at a low level, and M1' is turned on to set Q1' to a high voltage. M4 is turned on to write Data to the constant white signal, and M7 is turned on to write the constant white signal to the first pixel electrode P1, thereby displaying a white screen.

In one embodiment, when displaying the black and white screen, the display frequency is not limited to 1 Hz in the first pixel unit as shown in FIG. 8. In actual operation, when the black and white screen is displayed, the display frequency may be set lower.

In one embodiment, the constant black signal is a data voltage corresponding to a black screen, and the constant white signal is a data voltage corresponding to a white screen.

In one embodiment, when the first pixel unit shown in FIG. 8 is displaying at 60 Hz, that is, when displaying a grayscale screen, the FRP inputs a constant black signal.

During the first data write time phase, GateB outputs a low level, GateA1 outputs a high level, M5 is turned on, M6 is turned off, and Data is written to a low level, then the potential of Q1 is set to a low level, and M1' is turned on to set Q1' to a high level. M2 is turned on, so that Ctrl1 is set to a low voltage. M3 is turned off, and M4 is turned on.

During the display time phase, GateA1 outputs a low level, GateB outputs a high level, M5 is turned off, M6 is turned on to turn on the connection between Q1 and Ctrl1, the voltage of Q1 stays at a low level, and M1' is turned on to set Q1' to maintain a high voltage. While M4 is turned on, Data is written to the grayscale voltage signal, and M7 is turned on to write the grayscale voltage signal to the first pixel electrode P1, thereby displaying a grayscale screen.

In one embodiment, M6 is provided in the first pixel unit shown in FIG. 8. When GateA1 is turned on, that is, during the first data writing time phase, M5 is turned on, and M6 is turned off to write the low or high level signal input from Data to Q1, and then control the voltage of Q1'. Because M6 is turned off, when data is being written, the drain of MT is disconnected to the drain of M5. There is no race condition between the source of MT and the drain of M2', so that the race hazard won't occur.

After the data is written, GateA1 outputs a low level, M5 is turned off, M6 is turned on, the drain of MT is connected to the gate of M1', and M1, M1', M2, and MT form a latch ring. The stored signal is the signal written to the data line Data when GateA1 outputs a high level at the previous time, until GateA1 is turned on again and the signal on the data line Data is written to change the stored state of the previous time in the latch ring.

In one embodiment, the first pixel unit shown in FIG. 8 can achieve multi-grayscale display, thereby offering rich displaying colors and vibrant picture quality, which meet requirements for more products.

In one embodiment, when performing a grayscale display using the first pixel unit shown in FIG. 8, the display frequency is not limited to 60 Hz. In actual operation, when the grayscale screen is displayed, the display frequency may be set higher.

Figure 9:
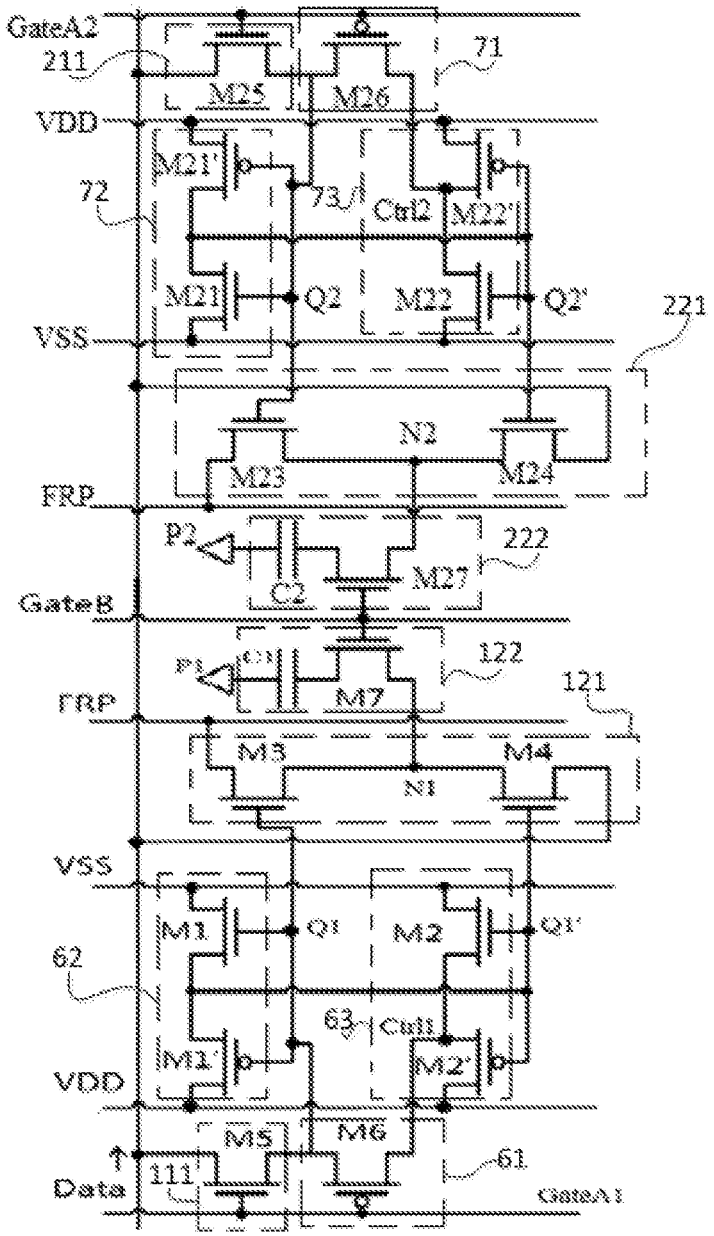
FIG. 9 is a circuit diagram of a pixel circuit according to one embodiment of the present disclosure.

As shown in FIG. 9, the pixel circuit described in one embodiment includes a first pixel unit and a second pixel unit.

The first pixel unit includes the first pixel electrode P1, the first control circuit and the first display drive circuit.

The first display driving circuit includes a first data control subcircuit 121 and a first display control sub-circuit 122.

The first display control subcircuit 122 includes a first display control transistor M7 and a first storage capacitor C1.

The gate of the first display control transistor M7 is connected to the display control line GateB, the drain of the first display control transistor M7 is connected to the first display control node N1, and the source of the first display control transistor M7 is connected to the first terminal of the first storage capacitor C1.

The second terminal of the first storage capacitor C1 is connected to the first pixel electrode P1.

The first data control subcircuit 121 includes a first data control transistor M3 and a second data control transistor M4.

The gate of the first data control transistor M3 is connected to the first positive phase node Q1, the drain of the first data control transistor M3 is connected to the black screen signal terminal FRP, and the source of the first data control transistor M3 is connected to the first display control node N1.

The gate of the second data control transistor M4 is connected to the first inverting phase node Q1', the drain of the second data control transistor M4 is connected to the first display control node N1, and the source of the second data control transistor M4 is connected to the data line Data.

The first control circuit includes a first write control subcircuit 111 and a first latch subcircuit.

The first latch subcircuit includes a first inverting phase control circuit 61, a first inverting phase circuit 62, and a second inverting phase circuit 63.

The first inverting phase control circuit 61 includes a first inverting phase control transistor M6.

The gate of the first inverting phase control transistor M6 is connected to the first write control line GateA1, the source of the first inverting phase control transistor M6 is connected to the first positive phase node Q1, and the drain of the first inverting phase control transistor M6 is connected to the first control node Ctrl1.

The first inverting phase circuit 62 includes a first inverting phase transistor M1 and a second inverting phase transistor Mr.

The gate of the first inverting phase transistor M1 is connected to the first positive phase node Q1, the source of the first inverting phase transistor M1 is connected to a low voltage terminal for inputting a low voltage VSS, and the drain of the first inverting phase transistor M1 is connected to the first inverting phase node Q1'.

The gate of the second inverting phase transistor M1' is connected to the first positive phase node Q1, the drain of the second inverting phase transistor M1' is connected to the first inverting phase node Q1', and the source of the second inverting phase transistor M1' is connected to a high voltage terminal for inputting a high voltage VDD.

The second inverting phase circuit 63 includes a third inverting phase transistor M2 and a fourth inverting phase transistor MT.

The gate of the third inverting phase transistor M2 is connected to the first inverting phase node Q1', the source of the third inverting phase transistor M2 is connected to the low voltage terminal, and the drain of the third inverting phase transistor M2 is connected to the first control node Ctrl1.

The gate of the fourth inverting phase transistor MT is connected to the first inverting phase node Q1', the drain of the fourth inverting phase transistor MT is connected to the first control node Ctrl1, and the source of the fourth inverting phase transistor MT is connected to the high voltage terminal.

The first write control subcircuit 111 includes a first write control transistor M5.

The gate of the first write control transistor M5 is connected to a first write control line GateA1, the source of the first write control transistor M5 is connected to the data line Data, and the drain of the first write control transistor M5 is connected to the first normal phase node Q1.

The second pixel unit includes the second pixel electrode P2, the second control circuit and the second display drive circuit 22.

The second display driving circuit 22 includes a second data control subcircuit 221 and a second display control subcircuit 222.

The second display control subcircuit 222 includes a second display control transistor M27 and a second storage capacitor C2.

The gate of the second display control transistor M27 is connected to the display control line GateB, the drain of the second display control transistor M27 is connected to the second display control node N1, and the source of the second display control transistor M27 is connected to the first terminal of the second storage capacitor C2.

The second terminal of the second storage capacitor C2 is connected to the second pixel electrode P2.

The second data control subcircuit 221 includes a third data control transistor M23 and a fourth data control transistor M24.

The gate of the third data control transistor M23 is connected to the second positive phase node Q2, the drain of the third data control transistor M23 is connected to the black screen signal terminal FRP, and the source of the third data control transistor M23 is connected to the second display control node N1.

The gate of the fourth data control transistor M24 is connected to the second inverting phase node Q2', the drain of the fourth data control transistor M24 is connected to the second display control node N2, and the source of the fourth data control transistor M24 is connected to the data line Data.

The second control circuit includes a second write control subcircuit 211 and a second latch subcircuit.

The second latch subcircuit includes a second inverting phase control circuit 71, a third inverting phase circuit 72 and a fourth inverting phase circuit 73.

The second inverting phase control circuit 71 includes a second inverting phase control transistor M26.

The gate of the second inverting phase control transistor M26 is connected to the second write control line GateA2, the source of the second inverting phase control transistor M26 is connected to the second positive phase node Q2, and the drain of the first the second inverting phase control transistor M26 is connected to the second control node Ctrl2.

The third inverting phase circuit 72 includes a fifth inverting phase transistor M21 and a sixth inverting phase transistor M21'.

The gate of the fifth inverting phase transistor M21 is connected to the second positive phase node Q2, the source of the fifth inverting phase transistor M21 is connected to a low voltage terminal for inputting a low voltage VSS, and the drain of the fifth inverting phase transistor M21 is connected to the second inverting node Q1'.

The gate of the sixth inverting phase transistor M21' is connected to the second positive phase node Q1, the drain of the sixth inverting phase transistor M21' is connected to the second inverting phase node Q2', and the source of the sixth inverting phase transistor M21' is connected to a high voltage terminal for inputting a high voltage VDD.

The fourth inverting phase circuit 73 includes a seventh inverting phase transistor M22 and an eighth inverting phase transistor M22'.

The gate of the seventh inverting phase transistor M22 is connected to the second inverting phase node Q2', the source of the seventh inverting phase transistor M22 is connected to the low voltage terminal, and the drain of the seventh inverting phase transistor M22 is connected to the second control node Ctrl2.

The gate of the eighth inverting phase transistor M22' is connected to the second inverting phase node Q2', the drain of the eighth inverting phase transistor M22' is connected to the second control node Ctrl2, and the source of the eighth inverting phase transistor MT is connected to the high voltage terminal.

The second write control subcircuit 211 includes a second write control transistor M25.

The gate of the second write control transistor M25 is connected to a second write control line GateA2, the source of the second write control transistor M25 is connected to the data line Data, and the drain of the second write control transistor M25 is connected to the second positive phase node Q2.

In one embodiments of the pixel circuit shown in FIG. 9, each transistor in the first pixel unit and each transistor in the second pixel unit are mirrored on both sides of the display control line GateB to facilitate sharing of GateB.

In one embodiments of the pixel circuit shown in FIG. 9, M6, M1', M2', M26, M21', and M22' are PMOS transistors, and other transistors are NMOS transistors, but not limited thereto.

In one embodiment of the pixel circuit shown in FIG. 9, the gate of M7 and the gate of M27 are both connected to GateB, which can save wiring space of GateB, thereby reducing the pixel pitch of the display panel and increasing the PPI. The first pixel unit and the second pixel unit form a pixel circuit, which use the same GateB to control displaying, thereby reducing the charging difference between the first pixel unit and the second pixel unit. In one embodiment, when the pixel circuit shown in FIG. 9 is in operation, only one external GOA may be needed to provide a display control signal. The GOA is generally disposed at the edges of the display panel. Therefore, the left and right border spaces may be saved to make a narrow border of the display panel.

In one embodiment, when the pixel circuit shown in FIG. 9 is in operation, the display period includes a data writing phase and a display time phase which are sequentially set.

The data writing phase includes a first data writing time phase and a second data writing time phase.

During the first data writing time phase, GateA1 outputs a high level, GateA2 and GateB both output a low level, M5 is turned on, M6 is turned off, and M7 is turned off. If a high level is written to Data, the voltage of Q1 is high and the voltage of Q1' is low, so that M3 is turned on and M4 is turned off. If a low level is written to Data, the voltage of Q1 is low and the voltage of Q1' is high, so that M3 is turned off and M4 is turned on.

During the second data writing time phase, GateA2 outputs a high level, GateA1 and GateB both output a low level, M25 is turned on, M26 is turned off, and M27 is turned off. If a high level is written to Data, the voltage of Q2 is high and the voltage of Q2' is low, so that M23 is turned on and M24 is turned off. If a low level is written to Data, the voltage of Q2 is low and the voltage of Q2' is high, so that M23 is turned off and M24 is turned on.

During the display time phase, GateB outputs a high level, GateA1 and GateA2 both output a low level, M5 is off, M6 is on, M7 is on, M25 is off, M26 is on, and M27 is on. M1, M1', M2 and MT form a latch ring to latch the voltage of Q1, and M21, M21', M22 and M22' form a latch ring to latch the voltage of Q2.

During the display time phase, if the voltage of Q1 is high and the voltage of Q1' is low, M3 is turned on, M4 is turned off, FRP is connected with N1, and M7 is turned on, so that the black screen signal provided by FRP is sent to P1 to display a black screen. If the voltage of Q1 is low and the voltage of Q1' is high, M3 is turned off, M4 is turned on, Data is connected to N1, and M7 is turned on, so that the data voltage signal according to Data is input to P1. When the data voltage signal is a constant white signal, a white screen is displayed When the data voltage signal is a grayscale voltage signal, a grayscale screen is displayed.

During the display time phase, if the voltage of Q2 is high and the voltage of Q2' is low, M23 is turned on, M24 is turned off, FRP is connected with N2, and M27 is turned on, so that the black screen signal provided by FRP is sent to P2, thereby displaying a black screen. If the voltage of Q2 is low and the voltage of Q2' is high, M23 is turned off, M24 is turned on, Data is connected with N2, and M27 is turned on, so that the data voltage signal according to Data is input to P2. When the data voltage signal is a constant white signal, a white screen is displayed. When the data voltage signal is a grayscale voltage signal, a grayscale screen is displayed.

The driving method of the pixel circuit according to some embodiments of the present disclosure is utilized to drive the pixel circuit. The display period includes a data writing phase and a display time phase which are sequentially set. The data writing phase includes a first data writing time phase and a second data writing time phase. The driving method of the pixel circuit includes:

during the first data writing time phase, the first control circuit controls and adjusts a voltage of the first positive phase node;

during the second data writing time phase, the second control circuit controls and adjust the voltage of the second positive phase node;

during the display time phase, the first control circuit latches the voltage of the first positive phase node. The second control circuit latches the voltage of the second positive phase node. Under the control of a display control signal input from the display control line and a voltage of the first positive phase node, the first display driving circuit provides a first display driving voltage to the first pixel electrode. Under the control of the display control signal and the voltage of the second positive phase node, the second display driving circuit provides a second display driving voltage to the second pixel electrode.

In the driving method of the pixel circuit according to one embodiment of the present disclosure, the first control circuit adjusts and latches the voltage of the first positive phase node, and the second control circuit adjusts and latches the voltage of the second positive phase node. The first and the second display driving circuits are controlled by the same display control signal to perform display control.

In some embodiments, the display module includes N rows and a plurality of columns of the above pixel circuits, where N is an integer greater than 1.

The display module further includes N rows of the display control lines.

The first pixel unit and the second pixel unit located in the nth row pixel circuits are both connected to the nth row display control line.

n is a positive integer less than or equal to N.

In one embodiment, the first display driving circuits in the first pixel units of the nth row pixel circuits are connected to the nth row display control line, and the second display driving circuits in the second pixel units of the nth row pixel circuits are also connected to the nth row display control line.

In one embodiment, the display module includes a plurality of rows and columns of the pixel circuits, and each of the pixel circuits in the nth row includes two pixel units connected to the nth row display control line.

The display module may further include 2N rows of write control lines.

The first pixel units in the nth row pixel circuits are connected to the (2n−1)th row of write control line, and the second pixel units located in the nth row pixel circuits are connected to the 2nth row of write control line.

In one embodiment, the first control circuits in the first pixel units of the nth row pixel circuits are connected to the (2n−1)th row of write control line, and the second control circuits in the second pixel units of the nth row pixel circuits are connected to the 2nth row of write control line.

The display module provided in some embodiments of the present disclosure may be any product or component having a display function, such as a mobile phone, a tablet computer, a television, a display, a notebook computer, a digital photo frame, a navigator, and the like.

In one embodiment, the display module includes N rows and a plurality of columns of pixel circuits as shown in FIG. 9. N is an integer greater than one.

The display module further includes N rows of the display control lines.

The first pixel units located in the nth row pixel circuits and the second pixel units located in the nth row pixel circuits are both connected to the nth row of display control line.

n is a positive integer less than or equal to N.

The first display driving circuits in the first pixel units of the nth row pixel circuits are connected to the nth row display control line, and the second display driving circuits in the second pixel units of the nth row pixel circuits are also connected to the nth row display control line.

Figure 10:
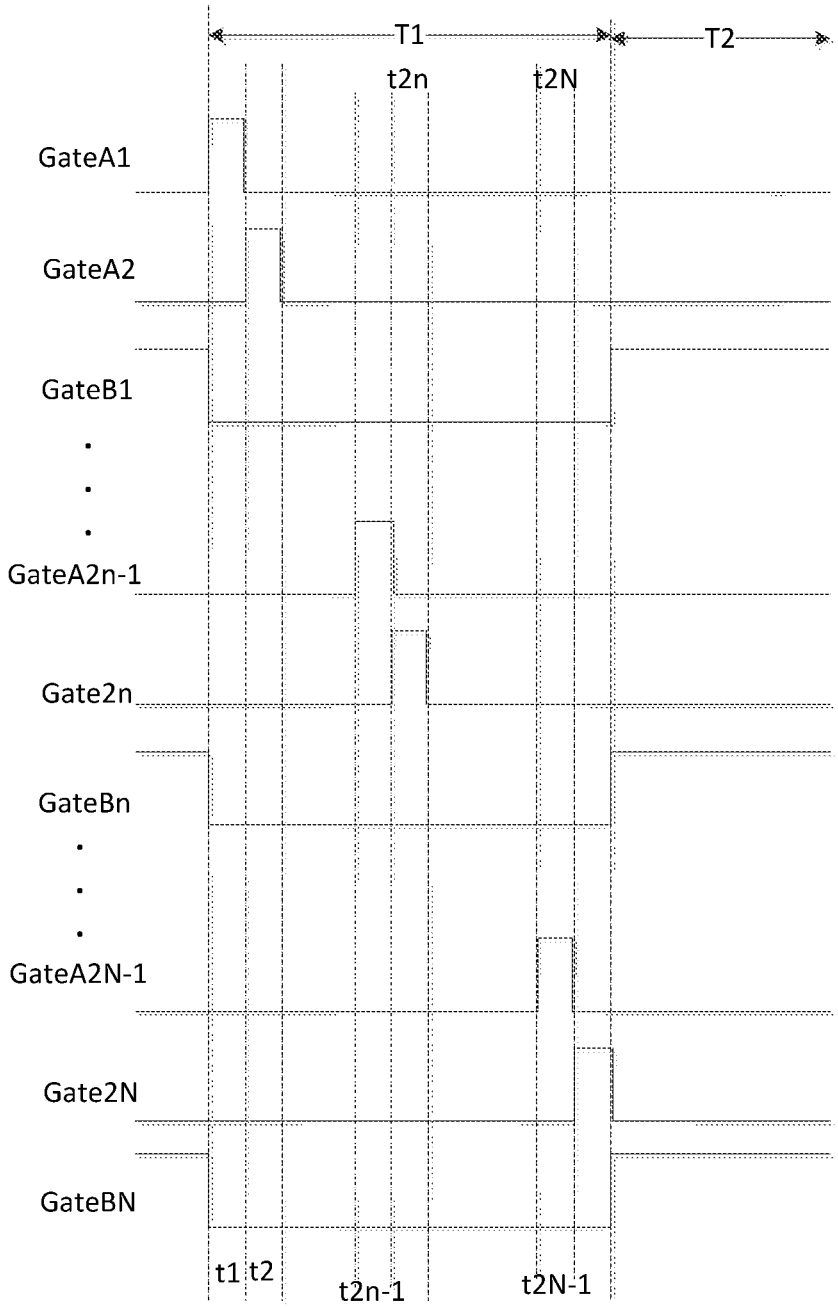
FIG. 10 is a timing diagram showing the operation of the pixel circuit as shown in FIG. 9 when displaying a black and white screen.

In one embodiment, when the display module is displaying a black and white screen, as shown in FIG. 10, the display period includes a data writing phase T1 and a display phase T2 which are sequentially set. The data writing phase T1 includes 2N data writing time phases sequentially arranged, where N is an integer greater than 1.

During the first data writing time phase t1 of the data writing phase T1, the first row write control line GateA1 outputs a high level, and the first control circuit in the first pixel unit of the pixel circuit of the first row controls and adjusts a voltage of the first positive phase node in the first pixel unit.

During the second data writing time phase t2 of the data writing phase T1, the second row write control line GateA2 outputs a high level, and the second control circuit in the second pixel unit of the pixel circuit of the first row controls and adjusts a voltage of the second positive phase node in the second pixel unit.

During the (2n−1)th data writing time phase t2*n*−1 of the data writing phase T1, the (2n−1)th row write control line GateA2*n*−1 outputs a high level, and the first control circuit in the first pixel unit of the nth row pixel circuit controls and adjusts a voltage of the first positive phase node in the first pixel unit, where n is a positive integer less than or equal to N.

During the 2nth data writing time phase t2*n* of the data writing phase T1, the 2nth row write control line GateA2*n* outputs a high level, and the second control circuit in the second pixel unit of the nth row pixel circuit controls and adjusts a voltage of the second positive phase node in the second pixel unit.

During the (2N−1)th data writing time phase t2N−1 of the data writing phase T1, the (2N−1)th row write control line GateA2N−1 outputs a high level, and the first control circuit in the first pixel unit of the nth row pixel circuit controls and adjusts a voltage of the first positive phase node in the first pixel unit.

During the 2Nth data writing time phase t2N of the data writing phase T1, the 2Nth row write control line GateA2N outputs a high level, and the second control circuit in the second pixel unit of the nth row pixel circuit controls and adjusts a voltage of the second positive phase node in the second pixel unit.

During the data writing phase T1, N lines display control lines all output a low level.

During the display phase T2, the first control circuit in the first pixel unit of each pixel circuit latches the voltage of the first positive phase node in the pixel unit, and the second control circuit in the second pixel unit of each pixel circuit latches the voltage of the second positive phase node in the pixel unit.

During the display phase T2, 2N row of write control lines all output a low level, N rows of display control lines all output a high level, and the first pixel unit and the second pixel unit of all the pixel circuits in the display module perform displaying. At this time, each data line outputs a constant white signal, and the black screen signal terminal outputs a constant black signal, and each pixel unit displays a black picture or a white picture under the control of the corresponding positive phase node.

In FIG. 10, GateB1 represents the first row display control line, GateBn represents the nth row display control line, and GateBN is the Nth row display control line.

In one embodiment, when the display module is in the black and white image display mode, because only the black or the white screen needs to be displayed, the data line provides a constant white signal (that is, a data voltage signal corresponding to a white screen), and the black screen signal terminal FRP provides a constant black signal (that is, a data voltage signal corresponding to a black screen). When driving the display module, it only needs to control the potential of each display control node to be a high level or a low level to achieve the black and white display, and the voltage on the data line does not need to be adjusted. Therefore, all display control lines in the display module can be controlled to be turned on during the display phase, so that the pixel units in all the pixel circuits in the display module display simultaneously.

Figure 11:
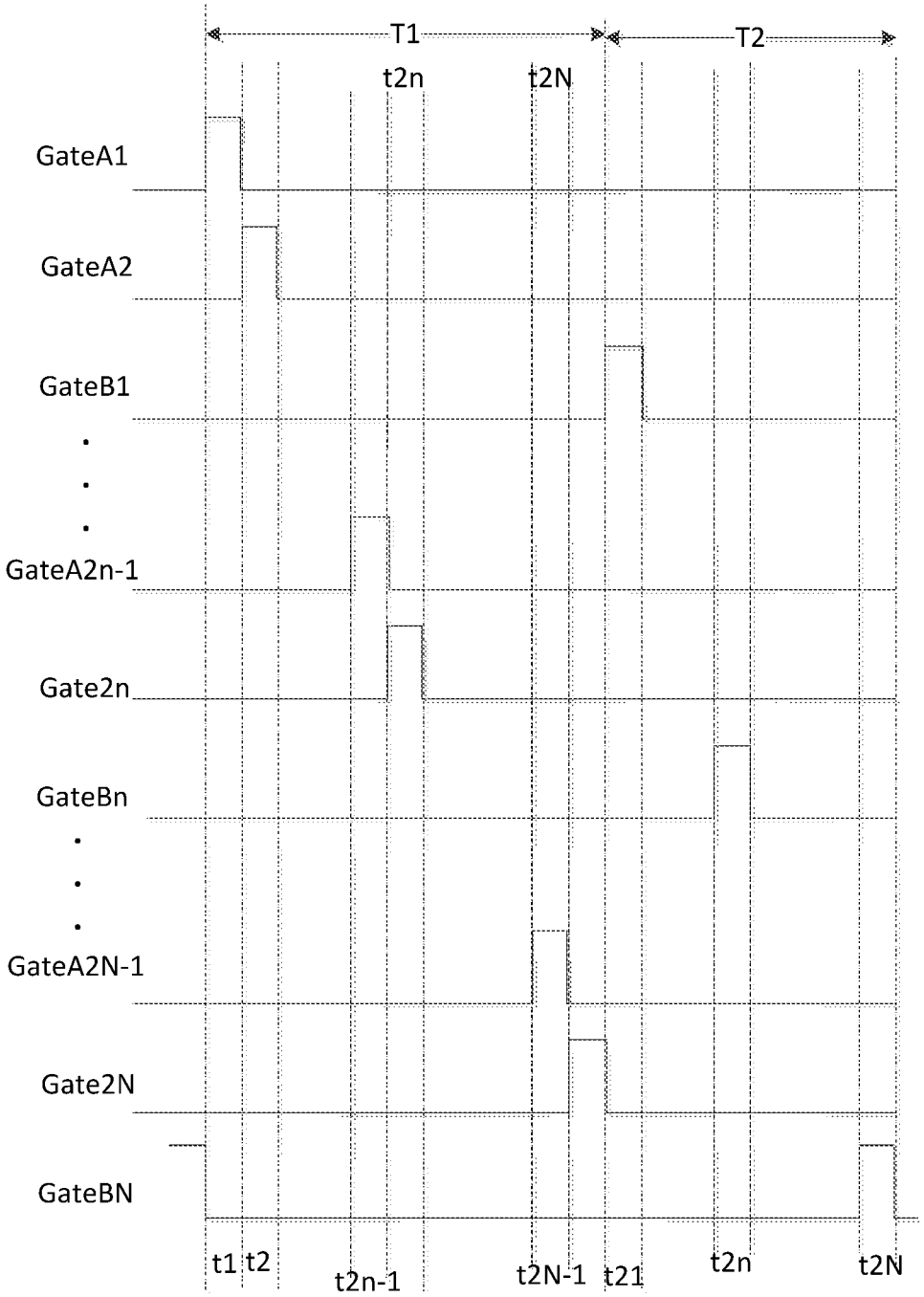
FIG. 11 is a timing diagram showing the operation of the pixel circuit shown in FIG. 9 when the grayscale screen is displayed.

In one embodiment, when the display module displays a grayscale screen, as shown in FIG. 11, the display period includes a data writing phase T1 and a display phase T2 which are sequentially set, and the data writing phase T1 includes 2N data write time phases sequentially set, the display phase T2 includes N display time phases sequentially set.

During the first data writing time phase t1 of the data writing phase T1, the first row write control line GateA1 outputs a high level, and the first control circuit in the first pixel unit of the pixel circuit of the first row controls and adjusts a voltage of the first positive phase node in the first pixel unit.

During the second data writing time phase t2 of the data writing phase T1, the second row write control line GateA2 outputs a high level, and the second control circuit in the second pixel unit of the pixel circuit of the first row controls and adjusts a voltage of the second positive phase node in the second pixel unit.

During the (2n−1)th data writing time phase t2*n*−1 of the data writing phase T1, the (2n−1)th row write control line GateA2*n*−1 outputs a high level, and the first control circuit in the first pixel unit of the nth row pixel circuit controls and adjusts a voltage of the first positive phase node in the first pixel unit.

During the 2nth data writing time phase t2*n* of the data writing phase T1, the 2nth row write control line GateA2*n* outputs a high level, and the second control circuit in the second pixel unit of the nth row pixel circuit controls and adjusts a voltage of the second positive phase node in the second pixel unit.

During the (2N−1)th data writing time phase t2N−1 of the data writing phase T1, the (2N−1)th row write control line GateA2N−1 outputs a high level, and the first control circuit in the first pixel unit of the nth row pixel circuit controls and adjusts a voltage of the first positive phase node in the first pixel unit.

During the 2Nth data writing time phase t2N of the data writing phase T1, the 2Nth row write control line GateA2N outputs a high level, and the second control circuit in the second pixel unit of the nth row pixel circuit controls and adjusts a voltage of the second positive phase node in the second pixel unit.

During the display phase T2, the first control circuit in the first pixel unit of each pixel circuit latches the voltage of the first positive phase node in the pixel unit, and the second control circuit in the second pixel unit of each pixel circuit latches a voltage of a second positive phase node in the pixel unit.

During the first display time phase t21 of the display phase T2, the first row display control line GateB1 in the display module is turned on to control the first display control circuit in the first pixel unit of the pixel circuit of the first row, under the control of the display control signal input by the first row display control line GateB1 and the voltage of the first positive phase node in the first pixel unit, to provide a first display driving voltage to the first pixel electrode in the first pixel unit; and to control the second display control circuit in the second pixel unit of the pixel circuit of the first row, under the control of the display control signal input by the first row display control line GateB1 and the voltage of the second positive phase node in the second pixel unit, to provide a second display driving voltage to the second pixel electrode in the second pixel unit.

During the nth display time phase t2*n* of the display phase T2, the nth row display control line GateBn in the display module is turned on to control the first display control circuit in the first pixel unit of the nth row pixel circuit, under the control of the display control signal input by the nth row display control line GateBn and the voltage of the first positive phase node in the first pixel unit, to provide a first display driving voltage to the first pixel electrode in the first pixel unit, and also to control the second display control circuit in the second pixel unit of the nth row pixel circuit, under the control of the display control signal input by the nth display control line GateBn and the voltage of the second positive phase node in the second pixel unit, to provide a second display driving voltage to the second pixel electrode in the second pixel unit. n is a positive integer less than or equal to N.

During the Nth display time phase t2N of the display phase T2, the nth row display control line GateBN in the display module is turned on to control the first display control circuit in the first pixel unit of the nth row pixel circuit, under the control of the display control signal input by the Nth row display control line GateBN and the voltage of the first positive phase node in the first pixel unit, to provide a first display driving voltage to the first pixel electrode in the first pixel unit, and to control the second display control circuit in the second pixel unit of the nth row pixel circuit, under the control of the display control signal input by the Nth display control line GateBN and the voltage of the second positive phase node in the second pixel unit, to provide a second display driving voltage to the second pixel electrode in the second pixel unit. n is a positive integer less than or equal to N.

In one embodiment, the display module is in the grayscale display mode. Because the grayscale display is required, the data lines provide different data voltages (ie, grayscale voltage) for each row of pixel circuits that are connected to the data lines. Therefore, the display phase includes N display time phases, and in the nth display time phase, the nth display control line is turned on, and display control is performed on the nth row of pixel circuits.

Figure 12:
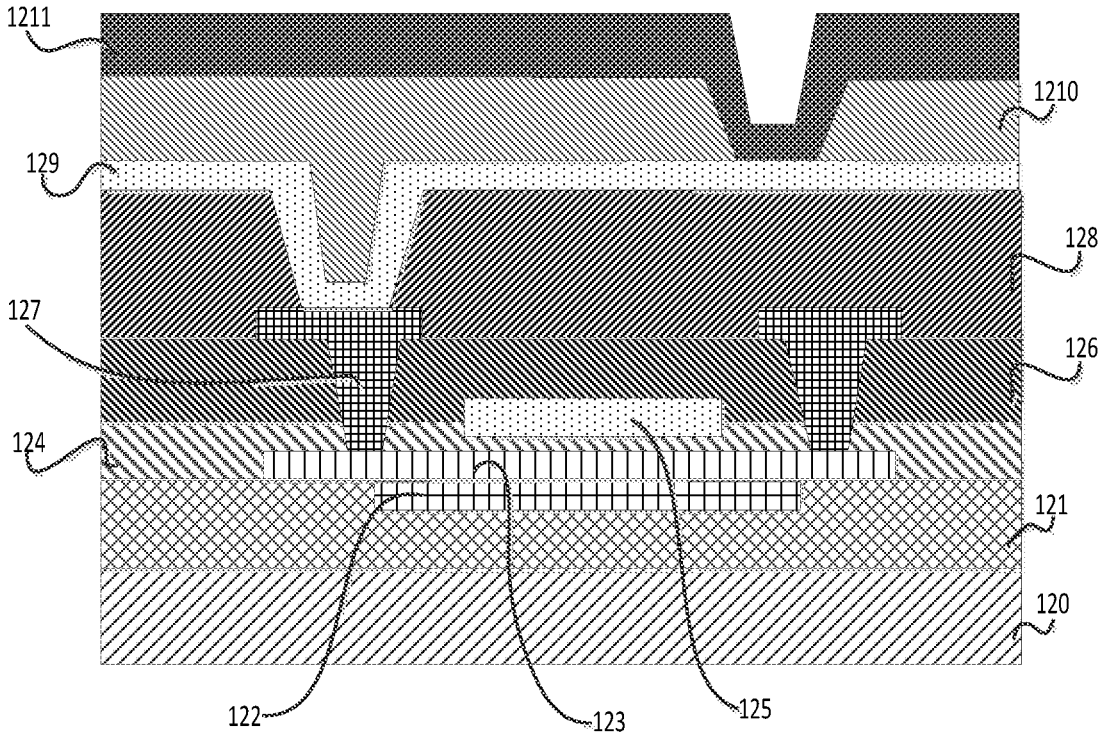
FIG. 12 is a schematic diagram of an array substrate in a display module according to one embodiment of the present disclosure.

As shown in FIG. 12, the display module according to one embodiment of the present disclosure includes an array substrate.

The array substrate includes a substrate 120, a buffer layer 121, a light shielding layer 122, a polysilicon layer 123, a gate insulating layer 124, a gate metal layer 125, an interlayer dielectric layer 126, a source/drain metal layer 127, a first insulating layer 128, a wiring layer 129, a second insulating layer 1210, and a pixel electrode layer 1211.

The wiring layer 129 may be made of ITO (indium tin oxide), and the pixel electrode layer 1211 may be made of Ag (silver), but not limited thereto;

As shown in FIG. 2A, the first subpixel electrode P11 and the second subpixel electrode P12 need to be electrically connected to each other through a conductive trace. Therefore, in one embodiment, an array substrate of the display module includes the wiring layer 129, and conductive traces are formed on the wiring layer 129.

In the array substrate of the display module according to one embodiment of the present disclosure, the pixel electrode layer 1211 may be made of silver to reflect light, and there is a gap between two adjacent pixel electrodes for light transmission. Therefore, it is convenient to achieve the transflective liquid crystal display.

In actual operation, the display module in one embodiment may further include a color film substrate, a front light source, a liquid crystal layer, and a back light source.

The color film substrate is disposed opposite the array substrate. The liquid crystal layer is disposed between the color film substrate and the array substrate. The front light source provides front light that is directed from the color film substrate to the array substrate. The back light source provides back light that is directed from the array substrate to the color film substrate. The front light is reflected by each pixel electrode in the pixel electrode layer, and the back light passes through gaps between adjacent pixel electrodes, thereby achieving transflective display.

In one embodiment, the pixel electrode layer 1211 may also be made of a transparent conductive material, but not limited thereto.

The driving method of the display module according to one embodiment of the present disclosure is employed to drive the display module. In the black and white screen display mode, the display period includes a data writing phase and a display phase which are sequentially set. The data writing phase includes 2N data writing time phases sequentially set. The driving method of the display module includes:

during the (2n−1)th data writing time phase, the first control circuit in the first pixel unit of the nth row pixel circuit controls and adjusts the voltage of the first positive phase node in the first pixel unit;

during the 2nth data writing time phase, the second control circuit in the second pixel unit of the nth row pixel circuit controls and adjusts the voltage of the second positive phase node in the second pixel unit;

during the display phase, the first control circuit latches the voltage of the first positive phase node, the second control circuit latches the voltage of the second positive phase node, and all rows of display control lines in the display module are all turned on. Under the control of the display control signals input by the corresponding display control lines and the voltage of the first positive phase node, the first display driving circuits of all the pixel circuits in the display module provide the first display driving voltages to the first pixel electrodes. Under the control of the display control signals input by the corresponding display control lines and the voltage of the second positive phase node, the second display driving circuits of all the pixel circuits in the display module provide the second display driving voltages to the second pixel electrodes.

n is a positive integer less than or equal to N.

The driving method of the display module according to one embodiment of the present disclosure is used to drive the display module. In the grayscale display mode, the display period includes a data writing phase and a display phase which are sequentially set, and the data writing phase includes 2N data writing time phases sequentially set, where the display phase includes N display time phases sequentially set. The driving method of the display module includes:

during the (2n−1)th data writing time phase, the first control circuit in the first pixel unit of the nth row pixel circuit controls and adjusts the voltage of the first positive phase node in the first pixel unit;

during the 2nth data writing time phase, the second control circuit in the second pixel unit of the nth row pixel circuit controls and adjusts the voltage of the second positive phase node in the second pixel unit;

during the display phase, the first control circuit latches the voltage of the first normal phase node, and the second control circuit latches the voltage of the second positive phase node;

during the nth display time phase, the nth row display control line in the display module is turned on to control the first display control circuit in the first pixel unit of the nth row pixel circuit, under the control of the display control signal input by the nth row display control line and the voltage of the first positive phase node, to provide a first display driving voltage to the first pixel electrode, and to control the second display control circuit in the second pixel unit of the nth row pixel circuit, under the control of the display control signal input by the nth display control line and the voltage of the second positive phase node, to provide a second display driving voltage to the second pixel electrode.

n is a positive integer less than or equal to N.

The above is a preferred embodiment of the present disclosure, and it should be noted that those skilled in the art can also make several improvements and modifications without departing from the principles of the present disclosure. It should be considered as the scope of protection of the present disclosure.

Moreover, the terms "first" and "second" are used for descriptive purposes only and are not to be construed as indicating or implying a relative importance or implicitly indicating the number of technical features indicated. Thus, features defining "first" or "second" may include at least one of the features, either explicitly or implicitly. In the description of the present disclosure, the meaning of "a plurality" is at least two, such as two, three, etc., unless specifically defined otherwise.

In the description of the present specification, the description with reference to the terms "one embodiment", "some embodiments", "example", "specific example", or "some examples" and the like means a specific feature described in connection with the embodiment or example. A structure, material or feature is included in at least one embodiment or example of the disclosure. In the present specification, the schematic representation of the above terms is not necessarily directed to the same embodiment or example. Furthermore, the particular features, structures, materials, or characteristics described may be combined in a suitable manner in any one or more embodiments or examples. In addition, those skilled in the art can combine and combine the different embodiments or examples described in the specification and the features of different embodiments or examples, without contradicting each other.

What is claimed is:

1. A display module, comprising N rows and a plurality of columns of pixel circuits comprising a pixel circuit, and N rows of display control lines, wherein N is an integer greater than one, wherein first pixel units in a nth row of the pixel circuits and second pixel units in the nth row of the pixel circuits are coupled to the nth row of the display control line, and n is a positive integer less than or equal to N;

wherein the pixel circuit includes:

a first pixel unit, comprising a first display driving circuit, a first pixel electrode coupled to the first display driving circuit, and a first control circuit coupled to the first display driving circuit;

a second pixel unit, comprising a second display driving circuit, a second pixel electrode coupled to the second display driving circuit, and a second control circuit coupled to the second display driving circuit, wherein the first display driving circuit and the second display driving circuit are coupled to a single display control line;

the first control circuit is configured to adjust and latch a voltage of a first positive phase node coupled to the first control circuit and the first display driving circuit, and the first display driving circuit is configured to provide a first display driving voltage to the first pixel electrode under control of a display control signal input by the display control line and the voltage of the first positive phase node; and the second control circuit is configured to adjust and latch a voltage of a second positive phase node coupled to the second control circuit and the second display driving circuit, and the second display driving circuit is configured to provide a second display driving voltage to the second pixel electrode under control of the display control signal and the voltage of the second positive phase node; and the first display driving circuit and the second display driving circuit are coupled to a data line;

wherein in a black and white screen display mode, a display period includes a data writing phase and a display phase which are set in this order, the data writing phase comprises 2N data writing time phases that are sequentially set, n is a positive integer less than or equal to N, the display module is configured:

during the (2n−1)th data writing time phase, to control and adjust the voltage of the first positive phase node in the first pixel unit by the first control circuit of the first pixel unit in one of the nth row of the pixel circuits;

during the 2nth data writing time phase, to control and adjust the voltage of the second positive phase node in the second pixel unit by the second control circuit of the second pixel unit in one of the nth row of the pixel circuits; and during the display phase, to latch the voltage of the first positive phase node by the first control circuit, latch the voltage of the second positive phase node by the second control circuit, turn on all rows of the display control lines in the display module, provide first display driving voltages to first pixel electrodes by first display driving circuits of all the pixel circuits in the display module under control of display control signals input by the corresponding display control lines and voltages of first positive phase nodes, and provide second display driving voltages to second pixel electrodes by second display driving circuits of all the pixel circuits in the display module under the control of display control signals input by the corresponding display control lines and voltages of second positive phase nodes.

2. The display module of claim 1, wherein first display driving circuits in the first pixel units and second display driving circuits in the second pixel units are coupled to the nth row of the display control line.

3. The display module according to claim 1, further comprising 2N rows of write control lines, wherein the first pixel units in the nth row of the pixel circuits are coupled to the (2n−1)th row of write control line, and the second pixel units in the nth row of the pixel circuits are coupled to the 2nth row of write control line; and first control circuits in the first pixel units are coupled to the (2n−1)th row of the write control line, and second control circuits in the second pixel units are coupled to the 2nth row of the write control line.

4. The display module according to claim 1, wherein the first control circuit and the second control circuit are mirrored on both sides of the display control line, and the first display driving circuit and the second display driving circuit are mirrored on both sides of the display control line.

5. The display module according to claim 1, wherein the first pixel electrode comprises a first subpixel electrode and a second subpixel electrode coupled to each other, the first subpixel electrode, the second pixel electrode, and the second subpixel electrode are arranged in this order.

6. The display module according to claim 1, wherein:

the first display driving circuit comprises a first data control subcircuit and a first display control subcircuit;

the first data control subcircuit is respectively coupled to the first positive phase node, a first inverting phase node coupled to the first display driving subcircuit and a first latch subcircuit, the data line, a black screen signal terminal, and a first display control node further coupled to the first display control subcircuit, and configured to control a connection between the first display control node and the black screen signal terminal under control of the first positive phase node and to control a connection between the first display control node and the data line under control of the first inverting phase node;

the first display control subcircuit is respectively coupled to the display control line, the first display control node and the first pixel electrode, and configured to control a voltage of the first pixel electrode according to a voltage of the first display control node under the control the display control signal input by the display control line.

7. The display module according to claim 6, wherein the first display control subcircuit comprises a first display control transistor and a first storage capacitor, a control terminal of the first display control transistor is coupled to the display control line, a first terminal of the first display control transistor is coupled to the first display control node, a second terminal of the first display control transistor is coupled to a first terminal of the first storage capacitor, and a second terminal of the first storage capacitor is coupled to the first pixel electrode.

8. The display module according to claim 6, wherein:

the first control circuit comprises a first write control subcircuit and the first latch subcircuit coupled to the first write control subcircuit, the first write control subcircuit is configured to control a connection between the data line and the first positive phase node under control of a first write control line, and the first latch subcircuit is configured to latch the voltage of the first positive phase node, and control a voltage of the first inverting phase node according to the voltage of the first positive phase node.

9. The display module according to claim 8, wherein the first write control subcircuit comprises a first write control transistor, a control terminal of the first write control transistor is coupled to the first write control line, a first terminal of the first write control transistor is coupled to the first positive phase node, and a second terminal of the first write control transistor is coupled to the data line.

10. The display module according to claim 8, wherein:

the first latch subcircuit comprises a first inverting phase control circuit, a first inverting phase circuit, and a second inverting phase circuit;

the first inverting phase control circuit is respectively coupled to the first write control line, the first positive phase node, and a first control node further coupled to the second inverting phase circuit, and configured to control a connection between the first positive phase node and the first control node under the control of the first write control line;

the first inverting circuit is respectively coupled to the first positive phase node and the first inverting phase node, and configured to control the voltage of the first inverting node to be opposite phase to the voltage of the first positive phase node; and the second inverting phase circuit is respectively coupled to the first control node and the first inverting phase node, and configured to control a voltage of the first control node to be opposite phase to the voltage of the first inverting phase node.

11. The display module according to claim 1, wherein:

the second display driving circuit comprises a second data control subcircuit and a second display control subcircuit;

the second data control subcircuit is respectively coupled to the second positive phase node, a second inverting phase node coupled to the second display driving subcircuit and a second latch subcircuit, the data line, a black screen signal terminal and a second display control node further coupled to the second display control subcircuit, and configured to control a connection between the second display control node and the black screen signal terminal under the control of the second positive phase node and to control a connection between the second display control node and the data line under the control of the second inverting phase node; and the second display control subcircuit is respectively coupled to the display control line, the second display control node and the second pixel electrode, and configured to control a voltage of the second pixel electrode according to a voltage of the second display control node under the control the display control signal input by the display control line.

12. The display module according to claim 11, wherein the second display control subcircuit comprises a second display control transistor and a second storage capacitor, a control terminal of the second display control transistor is coupled to the display control line, a first terminal of the second display control transistor is coupled to the second display control node, a second terminal of the second display control transistor is coupled to a first terminal of the second storage capacitor, and a second terminal of the second storage capacitor is coupled to the second pixel electrode.

13. The display module according to claim 11, wherein:

the second control circuit comprises a second write control subcircuit and the second latch subcircuit coupled to the second write control subcircuit, the second write control subcircuit is configured to control a connection between the data line and the second positive phase node under control of a second write control line, the second latch subcircuit is configured to latch the voltage of the second positive phase node and control a voltage of the second inverting phase node according to the voltage of the second positive phase node.

14. The display module according to claim 13, wherein the second write control subcircuit comprises a second write control transistor, a control terminal of the second write control transistor is coupled to the second write control line, a first terminal of the second write control transistor is coupled to the second positive phase node, and a second terminal of the second write control transistor is coupled to the data line.

15. The display module according to claim 13, wherein:

the second latch subcircuit comprises a second inverting phase control circuit, a third inverting phase circuit, and a fourth inverting phase circuit;

the second inverting phase control circuit is respectively coupled to the second write control line, the second positive phase node, and a second control node, and configured to control a connection between the second positive phase node and the second control node under the control of the second write control line;

the third inverting phase circuit is respectively coupled to the second positive phase node and the second inverting phase node, and configured to control the voltage of the second inverting phase node to be opposite phase to the voltage of the second positive phase node; and the fourth inverting phase circuit is respectively coupled to the second control node and the second inverting phase node, and configured to control a voltage of the second control node to be opposite phase to the voltage of the second inverting phase node.

16. A pixel circuit driving method for driving the pixel circuit of the display module according to claim 1, wherein a display period comprises a data writing phase and a display time phase which are set in this order, the data writing phase comprises a first data writing phase and a second data writing phase, the pixel circuit driving method comprises:

during the first data writing time phase, controlling and adjusting the voltage of the first positive phase node by the first control circuit;

during the second data writing time phase, controlling and adjusting the voltage of the second positive phase node by the second control circuit;

during the display time phase, latching the voltage of the first positive phase node by the first control circuit, latching the voltage of the second positive phase node by the second control circuit, providing the first display driving voltage to the first pixel electrode by the first display driving circuit under the control of the display control signal input from the display control line and the voltage of the first positive phase node, and providing the second display driving voltage to the second pixel electrode by the second display driving circuit under the control of the display control signal and the voltage of the second positive phase node.

17. A display module driving method for driving a display module, wherein the display module includes N rows and a plurality of columns of pixel circuits comprising a pixel circuit, and N rows of display control lines, where N is an integer greater than one, first pixel units in a nth row of the pixel circuits and second pixel units in the nth row of the pixel circuits are coupled to the nth row of the display control line, and n is a positive integer less than or equal to N;

wherein the pixel circuit includes:

a first pixel unit, comprising a first display driving circuit, a first pixel electrode coupled to the first display driving circuit, and a first control circuit coupled to the first display driving circuit;

a second pixel unit, comprising a second display driving circuit, a second pixel electrode coupled to the second display driving circuit, and a second control circuit coupled to the second display driving circuit, wherein the first display driving circuit and the second display driving circuit are coupled to a single display control line;

the first control circuit is configured to adjust and latch a voltage of a first positive phase node coupled to the first control circuit and the first display driving circuit, and the first display driving circuit is configured to provide a first display driving voltage to the first pixel electrode under control of a display control signal input by the display control line and the voltage of the first positive phase node; and the second control circuit is configured to adjust and latch a voltage of a second positive phase node coupled to the second control circuit and the second display driving circuit, and the second display driving circuit is configured to provide a second display driving voltage to the second pixel electrode under control of the display control signal and the voltage of the second positive phase node; and the first display driving circuit and the second display driving circuit are coupled to a data line;

wherein in a black and white screen display mode, a display period includes a data writing phase and a display phase which are set in this order, the data writing phase comprises 2N data writing time phases that are sequentially set, n is a positive integer less than or equal to N, the display module driving method comprises:

during the (2n−1)th data writing time phase, controlling and adjusting the voltage of the first positive phase node in the first pixel unit by the first control circuit of the first pixel unit in one of the nth row of the pixel circuits;

during the 2nth data writing time phase, controlling and adjusting the voltage of the second positive phase node in the second pixel unit by the second control circuit of the second pixel unit in one of the nth row of the pixel circuits; and during the display phase, latching the voltage of the first positive phase node by the first control circuit, latching the voltage of the second positive phase node by the second control circuit, turning on all rows of the display control lines in the display module, providing first display driving voltages to first pixel electrodes by first display driving circuits of all the pixel circuits in the display module under control of display control signals input by the corresponding display control lines and voltages of first positive phase nodes, and providing second display driving voltages to second pixel electrodes by second display driving circuits of all the pixel circuits in the display module under the control of display control signals input by the corresponding display control lines and voltages of second positive phase nodes.

18. A display module driving method for driving a display module, wherein the display module includes N rows and a plurality of columns of pixel circuits comprising a pixel circuit, and N rows of display control lines, where N is an integer greater than one, first pixel units in a nth row of the pixel circuits and second pixel units in the nth row of the pixel circuits are coupled to the nth row of the display control line, and n is a positive integer less than or equal to N;

wherein the pixel circuit includes:

a first pixel unit, comprising a first display driving circuit, a first pixel electrode coupled to the first display driving circuit, and a first control circuit coupled to the first display driving circuit;

a second pixel unit, comprising a second display driving circuit, a second pixel electrode coupled to the second display driving circuit, and a second control circuit coupled to the second display driving circuit, wherein the first display driving circuit and the second display driving circuit are coupled to a single display control line;

the first control circuit is configured to adjust and latch a voltage of a first positive phase node coupled to the first control circuit and the first display driving circuit, and the first display driving circuit is configured to provide a first display driving voltage to the first pixel electrode under control of a display control signal input by the display control line and the voltage of the first positive phase node; and the second control circuit is configured to adjust and latch a voltage of a second positive phase node coupled to the second control circuit and the second display driving circuit, and the second display driving circuit is configured to provide a second display driving voltage to the second pixel electrode under control of the display control signal and the voltage of the second positive phase node; and the first display driving circuit and the second display driving circuit are coupled to a data line;

wherein in a grayscale display mode, a display period includes a data writing phase and a display phase which are set in this order, the data writing phase comprises 2N data writing time phases that are sequentially set, the display phase includes N display time phases that are sequentially set, n is a positive integer less than or equal to N, the display module driving method comprises:

during the (2n−1)th data writing time phase, controlling and adjusting the voltage of the first positive phase node in the first pixel unit by the first control circuit of the first pixel unit in one of the nth row of the pixel circuits;

during the 2nth data writing time phase, controlling and adjusting the voltage of the second positive phase node in the second pixel unit by the second control circuit of the second pixel unit in one of the nth row of the pixel circuits;

during the display phase, latching the voltage of the first positive phase node by the first control circuit, and latching the voltage of the second positive phase node by the second control circuit;

during the nth display time phase, turning on the nth row of the display control line in the display module to control the first display control circuits of the first pixel units in the nth row of the pixel circuits to provide the first display driving voltage to the first pixel electrode under the control of the display control signal input by the nth row of the display control line and the voltage of the first positive phase node, and to control the second display control circuits of the second pixel units in the nth row of the pixel circuits to provide the second display driving voltage to the second pixel electrode under the control of the display control signal input by the nth row of the display control line and the voltage of the second positive phase node.

* * * * *